US012419338B2

(12) United States Patent
La Porta

(10) Patent No.: US 12,419,338 B2
(45) Date of Patent: Sep. 23, 2025

(54) METHOD AND SYSTEM FOR SPLICING TWO SHEETS OF MATERIAL CONTAINING ALKALOIDS

(71) Applicant: Philip Morris Products S.A., Neuchatel (CH)

(72) Inventor: Pietro Davide La Porta, Bologna (IT)

(73) Assignee: Philip Morris Products S.A., Neuchatel (CH)

( * ) Notice: Subject to any disclaimer, the term of this patent is extended or adjusted under 35 U.S.C. 154(b) by 395 days.

(21) Appl. No.: 18/044,875

(22) PCT Filed: Jul. 28, 2021

(86) PCT No.: PCT/EP2021/071147
§ 371 (c)(1),
(2) Date: Mar. 10, 2023

(87) PCT Pub. No.: WO2022/058079
PCT Pub. Date: Mar. 24, 2022

(65) Prior Publication Data

US 2023/0337714 A1 Oct. 26, 2023

(30) Foreign Application Priority Data

Sep. 18, 2020 (EP) ..... 20196812

(51) Int. Cl.
*A24B 3/14* (2006.01)
*A24C 5/01* (2020.01)
(Continued)

(52) U.S. Cl.
CPC ..... *A24B 3/14* (2013.01); *B65H 19/1852* (2013.01); *B65H 26/02* (2013.01); *A24C 5/01* (2020.01);
(Continued)

(58) Field of Classification Search
CPC ..... A24B 3/14; B65H 26/02; B65H 19/1852; B65H 2301/4602; B65H 2511/12; B65H 2511/13; B65H 2511/16; A24C 5/01
See application file for complete search history.

(56) References Cited

U.S. PATENT DOCUMENTS 3,749,634 A 7/1973 Krause
2016/0286852 A1* 10/2016 Gindrat et al. ..... A24C 5/399
2020/0198915 A1* 6/2020 Monzoni et al. .... B65H 19/123

FOREIGN PATENT DOCUMENTS

CN 102090713 A 6/2011
EP 0 882 412 A2 12/1998
(Continued)

OTHER PUBLICATIONS

International Search Report issued Oct. 11, 2021 in PCT/EP2021/071147 filed on Jul. 28, 2021, 4 pages.
(Continued)

*Primary Examiner* — Michael H. Wilson
*Assistant Examiner* — Ronnie Kirby Jordan
(74) *Attorney, Agent, or Firm* — Oblon, McClelland, Maier &Neustadt, L.L.P.

(57) ABSTRACT

A method for splicing two sheets of material containing alkaloids is provided, the method including: providing a first sheet of material containing alkaloids wound in a first bobbin; providing a second sheet of material containing alkaloids wound in a second bobbin; unwinding the first sheet wound in the first bobbin; evaluating one or more of the following parameters of the unwound first sheet: moisture, thickness, width, stickiness, and presence or absence of holes or tears; and depending on a value of the evaluated one or more parameters, unwinding the second sheet wound in the second bobbin, and splicing the first sheet and the second sheet. A system for splicing two sheets of material containing alkaloids is also provided.

14 Claims, 7 Drawing Sheets

(51) Int. Cl.
*B65H 19/18* (2006.01)
*B65H 26/02* (2006.01)

(52) U.S. Cl.
CPC ..... *B65H 2301/4602* (2013.01); *B65H 2408/217* (2013.01); *B65H 2511/12* (2013.01); *B65H 2511/13* (2013.01); *B65H 2511/16* (2013.01); *B65H 2553/42* (2013.01); *B65H 2553/46* (2013.01); *B65H 2701/171* (2013.01); *B65H 2701/20* (2013.01)

(56) References Cited

FOREIGN PATENT DOCUMENTS

| | | | |
|---|---|---|---|
| EP | 1 858 791 | B1 | 12/2008 |
| EP | 2 969 871 | B1 | 3/2017 |
| GB | 2 096 580 | A | 10/1982 |
| JP | 2006-027814 | | 2/2006 |
| JP | 2016-531544 | | 10/2016 |
| JP | 2016-500017 | | 1/2018 |
| RU | 2 680 706 | C2 | 2/2019 |
| WO | WO 2018/211118 | A1 | 11/2018 |

OTHER PUBLICATIONS

Combined Russian Decision of Grant and Search Report issued Jan. 9, 2025 in Russian Patent Application No. 2023109695/03 (with English Translation), 17 pages.

Japanese Office Action issued Jul. 3, 2025 in corresponding Japanese Patent Application No. 2023-517958, with English Translation, 8 pages.

* cited by examiner

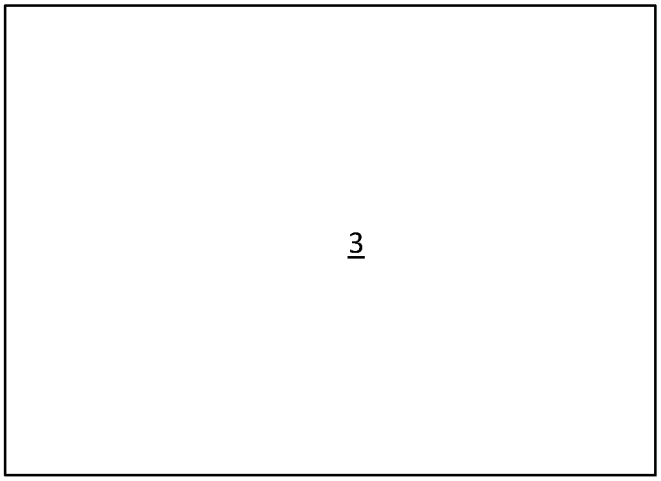
FIG. 12
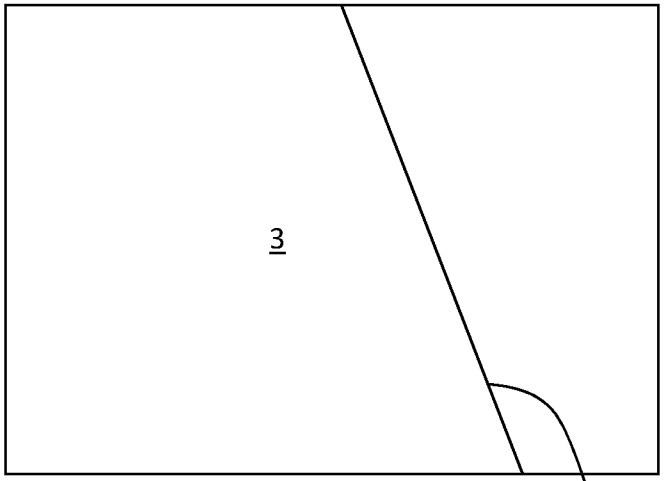
FIG. 13
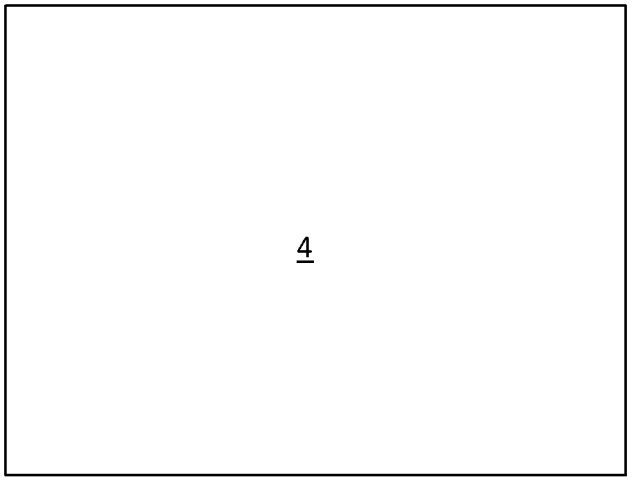
FIG. 10
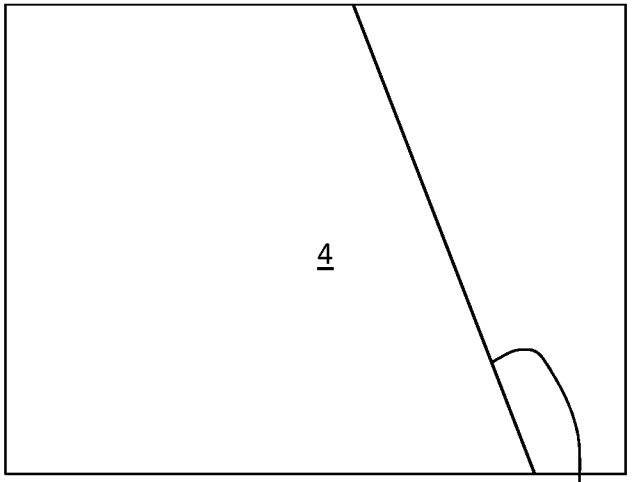
FIG. 11
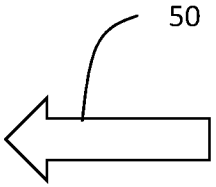
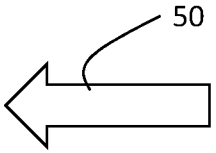

4
37
39
38

49
47
4
48
50
47
37
39
36
48
50

METHOD AND SYSTEM FOR SPLICING TWO SHEETS OF MATERIAL CONTAINING ALKALOIDS

The present invention relates to a method and a system to splice two sheets of material containing alkaloids, such as homogenized tobacco sheets.

In a manufacturing or production operation in which a sheet of material provided wound in a bobbin is processed, it may be desired to unwind the sheet from the bobbin at a high speed, so that the sheet can be processed at a high speed as well. For example, in the production of aerosol generating articles, the sheet may be a sheet of homogenized tobacco material.

When the bobbin is completely unwound or empty, the manufacturing or production process has to be slowed down or stopped in order to replace the empty bobbin by a new one.

In order to avoid a complete stoppage of production, the sheets wound in two different bobbins—an "old" bobbin and a "new" bobbin—can be spliced, so that a new bobbin replaces the old one before the old one is completed depleted.

It is also known to measure the decreasing diameter of a bobbin during its unwinding by means of one or more sensors. The sensor may be connected to a system able to trigger a change of bobbin, or a splice, when the bobbin diameter is below a predetermined threshold, which indicates that the bobbin has reached a determined depletion state.

However, also with the above systems, interruptions of the production may not be avoided. Several parameters may hinder the unwinding process: as examples, dirt may be present on the sheet's surface creating inhomogeneous zone in the sheet, or ambient or storage conditions may increase the "aging" of the sheet, making the sheet more prone to breakage. For instance, due to stickiness, portion of the sheet being unwound can remain stuck on the bobbin, tearing part of the sheet which is processed afterwards, weakening the sheet as well as preventing a correct amount of sheet to reach the downstream processes, jeopardizing the consistency of the final products.

Therefore, an object underlying the invention is to provide a method and an apparatus for splicing sheets of material wound in bobbins, which allow a higher processing speed of the material, in particular when replacing an unwound or empty bobbin by a new one.

According to an aspect, the invention relates to a method for splicing two sheets of material containing alkaloids. Preferably, the method comprises: providing a first sheet of material containing alkaloids wound in a first bobbin. Preferably, the method comprises: providing a second sheet of material containing alkaloids wound in a second bobbin. Preferably, the method comprises: unwinding the first sheet of material containing alkaloids wound in the first bobbin. Preferably, the method comprises evaluating one or more of the following parameters of the unwound first sheet of material containing alkaloids: moisture of the first sheet of material containing alkaloids; thickness of the first sheet of material containing alkaloids; width of the first sheet of material containing alkaloids; stickiness of the first sheet of material containing alkaloids; presence or absence of holes or tears in the first sheet of material containing alkaloids. Preferably, the method comprises, depending on the value of the evaluated one or more parameters: unwinding the second sheet of material containing alkaloids wound in the second bobbin. Preferably, the method comprises, depending on the value of the evaluated one or more parameters: splicing the first sheet of material containing alkaloids and the second sheet of material containing alkaloids.

According to the method of the invention, the condition of the first sheet is determined. The condition of the first sheet is determined by evaluating one or more of those parameters that hints to the integrity status of the first sheet or to whether the characteristics of the first sheet are within the required ranges. If the first sheet exhibits one or more parameters from which it is clear that the first sheet is not suitable for being further processed to obtain a final product within the required production specifications, a splicing action takes place, triggered by the evaluation of the parameters. In this way, faulty products are prevented and the waste of material is minimized. Furthermore, breakage of the first sheet may be prevented, because the weakening of the first sheet may be identified before the production stop is unavoidable.

Preferably, a first bobbin is provided. The first bobbin is formed by coils of a first sheet of material containing alkaloids. The first bobbin may be inserted in a first shaft adapted to rotate around its axis of rotation.

Preferably, a second bobbin is provided. The second bobbin is formed by coils of a second sheet of material containing alkaloids. The second bobbin may be inserted in a second shaft adapted to rotate around its axis of rotation. Preferably, the first sheet of material containing alkaloids and the second sheet of material containing alkaloids are identical, that is, they substantially have the same physical and chemical characteristics.

Preferably, a bobbin holder is provided, the bobbin holder comprising the first shaft and the second shaft, wherein the first shaft and the second shaft on the bobbin holder are moveable such that the positions of the first shaft and the second shaft are interchangeable with each other. The first shaft and the second shaft may be arranged in a movable manner on the bobbin holder. Alternatively, the first shaft and the second shaft may be fixedly arranged on the bobbin holder. In the latter case, the bobbin holder is movable, for example rotatable, such that the second bobbin may be positioned at the former position of the first bobbin and vice versa. The bobbin holder may also be provided with one or several further shafts for one or several further bobbins of sheet of material containing alkaloids, in addition to the first bobbin and second bobbin. While other interchanging mechanisms for the shafts are feasible, the positions of the plurality of shafts are preferably be brought into each other's position upon rotation of the bobbin holder or by rotating the shafts on the bobbin holder, respectively.

Each shaft may be associated with a sensor for detecting an upcoming end of the bobbin inserted in the shaft. For example, a first sensor and a second sensor for detecting an upcoming end of the bobbin may be provided, associated to the first shaft and the second shaft. For example, the diameter of the first bobbin is measured. For example, the diameter of the second bobbin is measured.

Further, a control unit may be provided. The first sensor or the second sensor for detecting an upcoming end of the first bobbin, of the second bobbin, or both, may be adapted to send a signal to the control unit when the amount of sheet in the bobbin is below a given threshold. For example, the first sensor or the second sensor for detecting an upcoming end of the bobbin may include a distance sensor, adapted to measure the distance between the sensor and the outer surface of the bobbin. When the distance is outside a pre-set range, then the distance sensor indicates that the first bobbin or the second bobbin may be almost depleted.

Further, the first sheet of material containing alkaloids is unwound from the bobbin. The first bobbin includes a free end, which is the head of the first sheet from which the first bobbin can be unwound. The unwinding may be performed for example by a suitable pulling roller. The first sheet defines a transport direction, which is the direction towards which it heads while the first bobbin unwinds. The transport direction may change while the first sheet is transported in the various stages of processing. Further, the first sheet defines a first surface and a second surface, opposite to each other. The distance between the first surface and the second surface is the thickness of the sheet.

Preferably, the transport of the first sheet is performed at speed of the first sheet comprised between about 50 meters per minute and about 400 meters per minute.

One or more parameters of a portion of the unwound first sheet are evaluated according to the method of the invention. Preferably, the evaluation is performed before the first sheet is further processed, that is, preferably the evaluation is performed substantially immediately after unwinding.

Preferably, the method of the invention includes evaluating the moisture of the first sheet of material containing alkaloids. Preferably, the method of the invention includes evaluating the thickness of the first sheet of material containing alkaloids. Preferably, the method of the invention includes evaluating the width of the first sheet of material containing alkaloids. Preferably, the method of the invention includes evaluating the stickiness of the first sheet of material containing alkaloids. Preferably, the method of the invention includes evaluating the presence or absence of holes or tears in the first sheet of material containing alkaloids. More preferably, the method of the invention comprises evaluating at least two of the following parameters: moisture of the first sheet of material containing alkaloids; or thickness of the first sheet of material containing alkaloids; or width of the first sheet of material containing alkaloids; or stickiness of the first sheet of material containing alkaloids; or presence or absence of holes or tears in the first sheet of material containing alkaloids. The value of the one or more of the above parameters, called "integrity parameters" of the first sheet in the following for short, may indicate that the first sheet of material containing alkaloids does not have any more the prescribed characteristics in order to produce an acceptable final product within the desired tolerances. The final product may be for example an aerosol generating article. The value of the one or more integrity parameters of the first sheet may indicate that the first sheet of material containing alkaloids may be going to break in the near future. For example, the value may indicate that the first sheet of material containing alkaloids may break before the first sheet is gathered into a rod. For example, the value of the integrity parameter may indicate that the first sheet of material containing alkaloids may break before it is wrapped by a wrapper. For example, the value of the integrity parameter may indicate that the first sheet of material containing alkaloids may soon break causing a machine stop.

With "evaluating one or more of the following parameters", the evaluation of the parameter itself is meant, such as the evaluation of the value of moisture, or thickness, or width, or stickiness of the first sheet of material containing alkaloids, or the detection of the presence or absence of holes or tears. "Evaluating one or more of the following parameters" also means to the evaluate a value difference between a reference value and an actual measured value. With "evaluating one or more of the following parameters", the evaluation of the rate of change of a specific parameter is also meant. For example, the change in the value of moisture, or thickness, or width, or stickiness of the first sheet of material containing alkaloids may be evaluated. A reference value for moisture, or thickness, or width, or stickiness of the first sheet of material containing alkaloids may be inputted or measured and variations from this reference value may be evaluated.

The evaluated integrity parameter may be measured, for example using a suitable sensor. Preferably, the sensor measures the integrity parameter real-time, that is, the integrity parameter of the first sheet is preferably measured during processing of the first sheet. Furthermore, due to the fact that the first sheet moves in the transport direction, the one or more parameters are measured continuously. Alternatively, the one or more parameters are measured at a given frequency. The given frequency may be constant. The given frequency may be variable. Preferably, the given frequency is synchronised with the speed of transport of the first sheet. The given frequency may change depending on the transport conditions of the first sheet. For example, if the speed of transport of the first sheet remains constant, preferably the frequency of the measurement is also constant. Alternatively, if the first sheet accelerates, preferably the frequency of measurement is higher than the frequency kept during constant speed of the sheet, because the first sheet is subjected to higher stress during acceleration. In this way, several portions of the first sheet are checked. Therefore, the integrity parameter of the first sheet is preferably measured at predetermined subsequent time intervals. The duration of these time intervals in which the measurement takes place may vary.

Measuring the integrity parameter of the sheet means measuring the integrity parameter of the sheet at least in a predetermined location, that is, the integrity parameter of at least a first portion of the first sheet is measured at each time interval.

Any sensor to measure one of the integrity parameters is preferably positioned in such a way that the integrity parameter is measured in a portion of the first sheet already unwound from the bobbin. That is, the portion of the first sheet where the integrity parameter is measured preferably does not belong anymore to the first bobbin outer surface.

One sensor or more sensors for measuring the same integrity parameter could be used to measure the same integrity parameter of the first sheet. The same integrity parameter of the first sheet may be measured in one location or in more locations at each time interval. If measured in more than one location, each measurement produces data and the data are gathered. The gathered data from the different measurements may be statistically combined. A mean (average) of all measurements of the same integrity parameter may be performed. Thus, for each time interval, a combination of several values of the same integrity parameter may be collected, the different values being measured in different portions of the first sheet.

In case two different sensors measuring two different integrity parameters are present, preferably the two different integrity parameters are measured in the same portion of the first sheet. Preferably, the different integrity parameters are measured at the same frequency. Preferably, the measurements of different integrity parameters are synchronised.

Preferably, the sensor adapted to measure the integrity parameter of the first sheet is stationary and the first sheet moves.

The first sheet has a thickness. In case the thickness is measured as the integrity parameter, a thickness sensor adapted to measure the thickness of the first sheet of material containing alkaloids and to emit a signal on the basis of the thickness measurement, may be used.

The thickness sensor may comprise a mechanical sensor. The thickness sensor may comprise an optical sensor. The thickness sensor may comprise a mechanical sensor and an optical sensor. In case of an optical sensor, the optical sensor may comprise a light source. A beam of electromagnetic radiation emitted by the light source may impinge the first sheet. Variations in the intensity of the transmitted light beam through the first sheet may indicate a variation of thickness in the first sheet.

Splicing may take place depending on the measured value of the thickness of the first sheet.

If the measured thickness is above or below a thickness threshold, the thickness sensor may send a signal to the control unit, informing that the thickness is outside a preferred range of thickness parameter values. For example, a signal can be sent if the first sheet's thickness is lower than a certain threshold. Alternatively, the thickness sensor may send signals representative to the thickness of the first sheet at each measurement and the control unit may perform the comparison with the thickness threshold. For example, a threshold can be set which is equal to a selected percentage of a reference value for a thickness of the first sheet. The selected percentage is for example 25 percent, 20 percent, 15 percent, or 10 percent. The reference value for the thickness is preferably a value comprised between 150 micrometres and 350 micrometres, more preferably between 200 micrometres and 300 micrometres. If the thickness of the first sheet is lower than the reference value of thickness by more than the selected percentage, then the signal is sent to the control unit. Otherwise, a reference value for the thickness is set. If the measured thickness is lower than the reference value by more than a fixed value, then the signal is sent. The fixed value may be 50 micrometres, 30 micrometres, 25 micrometres, 15 micrometres, 10 micrometres. The thickness sensor may send a signal to the control unit when a change in thickness above a variation thickness threshold is measured. In addition, a signal may also be sent, if a change of the thickness of the first sheet takes place too fast. For example, if the measured value of the thickness in three consecutive measurements vary more than 15 percent, this indicates that a damage in the first sheet may be present.

If the thickness of the first sheet is measured at a plurality of locations, such as N locations (where N is an integer), at each time interval, splicing may be triggered only if the thickness is below the thickness threshold in at least M locations (where M is an integer), where $1<M<N$ locations.

A variation of thickness may indicate that a portion of the first sheet has remained stuck in the bobbin, for example because the first sheet has become too sticky. This may trigger a tear in the first sheet in the near future, such as before the first sheet is crimped, or before the first sheet is gathered into a rod, or before the first sheet is buffered. Alternatively or in addition, a too thin first sheet may indicate the possibility of a tear. A too thick first sheet may indicate the presence of defects in the first sheet which may lead to possible obstruction or not optimal results in further processing steps. Further processing steps may include crimping or gathering of the sheet into a rod.

The first sheet has a moisture. In case the moisture is measured as the integrity parameter, a moisture sensor adapted to measure the moisture of the first sheet of material containing alkaloids and to emit a signal on the basis of the moisture measurement may be used. The moisture sensor may comprise a Grammage sensor. The moisture sensor may include a camera. The moisture sensor may include an infra-red camera. The moisture sensor may comprise a microwave source. As an example, the infrared gauge TM710 by NDC Technologies may be used as a moisture sensor. Another example is the Perten DA 7440 near-infrared sensor.

Splicing may take place depending on the measured value of the moisture of the first sheet.

If the measured moisture is above or below a moisture threshold, the moisture sensor may send a signal to the control unit, informing that the moisture is outside a preferred range of moisture parameter values. For example, a signal can be sent if the first sheet's moisture is lower than a certain threshold. For example, a signal can be sent if the first sheet's moisture is higher than a certain threshold. Alternatively, the moisture sensor may send signals representative to the moisture of the first sheet at each measurement and the control unit may perform the comparison with the moisture threshold. For example, a threshold can be set which is equal to a selected percentage of a reference value for a moisture of the first sheet. The percentage is for example 25 percent, 20 percent, 15 percent, or 10 percent. The reference value for the moisture is preferably a value comprised between 7 percent and 15 percent of water in the total weight of the first sheet. If the moisture of the first sheet is lower or higher than the reference value of moisture by more than the selected percentage, then the signal is sent to the control unit. Alternatively, a reference value for the moisture is set. If the measured moisture is lower than the reference value by more than a fixed value, then the signal is sent. If the measured moisture is higher than the reference value by more than a fixed value, then the signal is sent. The fixed value may be 2 percent of water in total weight, 1.5 percent of water in total weight, 1 percent of water in total weight, 0.5 percent of water in total weight. The moisture sensor may send a signal to the control unit when a change in moisture above a variation moisture threshold is measured. In addition, a signal may also be sent, if a change of the moisture of the first sheet takes place too fast. For example, if the measured value of the moisture in three consecutive measurements vary more than 15 percent, this indicates that out of specification first sheet may be present.

If the moisture of the first sheet is too low, the first sheet may easily crack and tears or holes may form in the first sheet, leading to a possible rupture. Further, a too dry sheet during crimping may shatter in pieces, so gathering the crimped sheet in a rod may become impossible. If the moisture of the first sheet is too high, the first sheet may be too sticky and an excessive force may be needed to unwind it, which may become higher than the tensile strength of the sheet, causing a breakage.

The first sheet defines a width. The width of the sheet is the dimension of the sheet in a direction substantially perpendicular to the transport direction of the sheet. The width of the sheet is also substantially perpendicular to the thickness of the sheet. In case the width is measured as the integrity parameter, a width sensor adapted to measure the width of the first sheet of material containing alkaloids and to emit a signal on the basis of the width measurement may be used. The width sensor may be a distance sensor. The width sensor may include a light barrier sensor. The width sensor may include a camera.

Splicing may take place depending on the measured value of the width of the first sheet.

If the measured width of the first sheet is above or below a width threshold, the width sensor may send a signal to the control unit, informing that the width is outside a preferred range of width parameter values. For example, a signal can be sent if the first sheet's width is lower than a certain threshold. For example, a signal can be sent if the first sheet's width is higher than a certain threshold. Alternatively, the width sensor may send signals representative to the width of the first sheet at each measurement and the control unit may perform the comparison with the width threshold. For example, a threshold can be set which is equal to a selected percentage of a reference value for a width of the first sheet. The percentage is for example 25 percent, 20 percent, 15 percent, or 10 percent. The reference value for the width is preferably a value comprised between 120 millimetres and 130 millimetres. If the width of the first sheet is lower or higher than the reference value of width by more than the selected percentage, then the signal is sent to the control unit. Alternatively, a reference value for the width is set. If the measured width is lower than the reference value of the width by more than a fixed value, then the signal is sent. If the measured width is higher than the reference value by more than a fixed value, then the signal is sent. The fixed value may be 5 millimetres, 2 millimetres. The width sensor may send a signal to the control unit when a change in width above a variation width threshold is measured. In addition, a signal may also be sent if a change of the width of the first sheet takes place too fast. For example, if the measured value of the width in three consecutive measurements vary more than 15 percent, this indicates that out of specification first sheet may be present.

A too small width may indicate that a piece of the first sheet is missing. This may indicate that the first sheet may break soon. A high width may indicate a defect in the casting process of the first sheet and sub-optimal final products may be obtained. A high width may be an indication that some of the material containing alkaloids in the first sheet is loose, or a hole or a slit in the centre of the first sheet has formed, so that the material deviates towards the sides of the sheet.

The first sheet has a stickiness. In case the stickiness is measured as the integrity parameter, a stickiness sensor adapted to measure the stickiness of the first sheet of material containing alkaloids and to emit a signal on the basis of the stickiness measurement, may be used.

The stickiness sensor may comprise a distance sensor or an angle sensor. A quantity that is related to the stickiness of the bobbin is the so called "peeling angle", which is the angle formed between a reference line (for example a reference diameter of the first bobbin) and the detachment line, that is, a line passing through the line where the first sheet detaches from the first bobbin. If this angle increases, it may mean that the stickiness of the first sheet increased. If this angle decreases, it may mean that the stickiness of the first sheet decreased. The angle may also be measured by measuring a distance between the first sheet unwound from the bobbin and the sensor. The stickiness sensor may include a pressure distribution sensor.

Splicing may take place depending on the measured value of the stickiness of the first sheet.

If the measured stickiness is above or below a stickiness threshold, the stickiness sensor may send a signal to the control unit, informing that the thickness is outside a preferred range of stickiness parameter values. For example, a signal can be sent if the first sheet's stickiness is higher than a certain threshold. Alternatively, the stickiness sensor may send signals representative to the stickiness of the first sheet at each measurement and the control unit may perform the comparison with the stickiness threshold. For example, a threshold can be set which is equal to a selected percentage of a reference value for a stickiness of the first sheet. The percentage is for example 25 percent, 20 percent, 15 percent, or 10 percent. If the stickiness of the first sheet is higher than the reference value of stickiness by more than the selected percentage, then the signal is sent to the control unit. Alternatively, reference value for the stickiness is set. If the measured stickiness is higher than the reference value by more than a fixed value, then the signal is sent. The stickiness sensor may send a signal to the control unit when a change in stickiness above a variation stickiness threshold is measured. In addition, a signal may also be sent if a change of the stickiness of the first sheet takes place too fast. For example, if the measured value of the stickiness in three consecutive measurements vary more than 15 percent, this indicates that out of specification first sheet may be present.

If the stickiness is too low, it may mean that an error in the composition of the slurry used to produce the first sheet of material containing alkaloids has taken place and the first sheet may not lead to final products according to specifications. If the first sheet is too sticky, an excessive force may be needed to unwind it, which may become higher than the tensile strength of the first sheet, causing a breakage. Without being bound by theory, a too sticky first sheet may be an indication that the binder in the sheet has not properly created a "strong" structure. This may be create a weak bonding of the fibres within the slurry together. Therefore, the stickier the sheet, the smaller its tensile strength, which in turn increases the danger of rupture while unwinding the bobbin.

In case the presence or absence of holes or tears is detected, a sensor to detect the presence or absence of holes or tears in the first sheet of material containing alkaloids may be used.

The sensor may be an optical sensor or a sound sensor. The sound sensor may include an ultrasound sensor. The optical sensor may comprise a camera. The optical sensor may comprise a light source. A beam of electromagnetic radiation emitted by the light source may impinge the first sheet. Variations in the intensity of the transmitted light beam through the first sheet may indicate a presence of a hole or a tear in the first sheet. Ultrasonic sensors transmit and receive sound waves in the ultrasonic range. An ultrasonic wave impinging on a surface of the first sheet creates a reflected wave. The reflected wave changes if holes or tears are present on the surface of the first sheet and these variations of the reflected wave can be measured.

The "presence or absence" of tears or holes does not mean that all holes or tears may be considered in the evaluation, regardless of their dimension. First, there is a first minimum dimensions for the holes or tears in order to be detected by the sensor. This first minimum dimension depends on the resolution of the sensor. Furthermore, relatively "small" holes or tears may pose no threat to the integrity of the first sheet and may not be an indicator of a breakage going to take place. Therefore, a "second minimum dimension" of the hole or of the tear may be set and only holes or tears above such second minimum dimension may be considered in the evaluation as confirming the presence of a hole or of a tear. Relatively "big" holes or tears may hint that the first sheet is weakening and that it may break soon. The second minimum dimension may be 5 millimetres, or 10 millimetres. This means that only holes or tears having a dimension bigger than 5 millimetres, or bigger than 10 millimetres, are considered to indicate "presence of holes or tears". The dimension considered is the dimension transvers to the transport direction. Furthermore, instead of a linear dimension, the threshold could be an area, that is, the holes or tears are considered as holes or tears only if their area is above a given area threshold.

Splicing may take place if the presence of holes or tears in the first sheet is detected.

When, instead of an absolute value of an integrity parameter, a variation of the integrity parameter is measured, preferably the variation is measured with respect to a reference value. In other words, the variation is taken with respect to a reference value which is supposedly the "acceptable" value of the integrity parameter. This reference parameter may be used as a threshold of the measured value of the integrity parameter. For example, splicing may take place is the measured value of the integrity is above or below the reference value of the same integrity parameter of plus/minus 10 percent, or 15 percent, or 25 percent of the reference value.

The reference value could be a variable which is updated while the measurements take place. For example, starting with a set reference value, every N consecutive measurement, where N is an integer, the reference value is updated and its new value is equal to the value which has been measured by the sensor N measurements ago.

Furthermore, also the rate of change of the measured value may be of relevance. If the rate of change is above a given threshold, then splicing takes place independently from the absolute value of the change.

The reference integrity parameter may be obtained by means of a database. The reference integrity parameter may be used to evaluate whether there is a variation of that integrity parameter above a given threshold. The method of the invention preferably includes accessing a database and retrieving from the database data relative to one of the reference integrity parameters of the first sheet. The database may include one or more of the reference integrity parameters values: thickness, moisture, width, stickiness of the first sheet. The data relative to one or more reference integrity parameters may be stored in an accessible memory where the database is present. The data may be present on a sticker or barcode attached to the bobbin from which the first sheet is unwound. These data can be scanned in a known manner and uploaded in the control unit. Furthermore, the thresholds of the parameters may depend on the composition of the first sheet or on the batch of the bobbin. Therefore, the database may include several thresholds the parameters are compared with, a plurality of threshold for a single parameter, and depending on the composition of the sheet, a different threshold is selected for that parameter among the plurality.

The reference integrity parameter may be obtained by user's input. A panel or other input device may be provided and an user, for example an operator, may enter the value of a reference integrity parameter of the first sheet. Further, data relating to one of the reference integrity parameters may be obtained scanning data provided on the first bobbin made of the first sheet, for example a representative code.

The reference integrity parameter may be obtained by a remote signal. A wireless or cabled data transmission may take place to input the reference integrity parameter.

As a consequence of the evaluation, for example as a consequence of the measurements by one or more sensors, of the one or more integrity parameters of the first sheet, one or more values or one or more values differences are rendered available. Those values or values differences may then be elaborated by the control unit. The control unit preferably elaborates one or more signals coming from sensors measuring the integrity parameters of the first sheet. The one or more signals are indicative of the value of the one or more integrity parameters.

Preferably, more than one reference integrity parameters of the first sheet is measured. Preferably, the width of the first sheet is obtained. Preferably, the presence or absence of holes and tears of the first sheet is obtained. Preferably, the width and the presence or absence of holes and tears of the first sheet are obtained. Preferably, the combination of the presence or absence of tears and holes and the thickness of the first sheet are obtained. Preferably, the combination of the presence or absence of tears and holes and the moisture of the first sheet are obtained. Preferably, the combination of the presence or absence of tears and holes and the stickiness of the first sheet are obtained.

After the evaluation, depending on the value of evaluated one or more of the integrity parameters, a splicing step takes place. The splicing takes place in a splicing unit. For example, if in the evaluation step one or more of the integrity parameters is outside a predefined range, then the splicing of the first sheet and the second sheet takes place. If in the evaluation, holes or tears are present, then splicing may take place.

The control unit forces the splicing depending on the value of the one or more signals sent by the sensors measuring the integrity parameters, that is, splicing is forced depending on the value of the one or more integrity parameters. The control unit may force the splicing if the elaborated value of the one or more integrity parameters is outside a given range. For each integrity parameter, a range may be pre-set. For each integrity parameter, several ranges may be pre-set. For example, for each integrity parameter, a green range may be pre-set. If all the values or value differences measured by the sensors or all the signals elaborated by the control unity are within their respective green ranges, no splicing is triggered by the control unit. Splicing may still take place due to a different measurement or command, such for example due to the depletion of the first bobbin. However, no splicing is triggered due to the elaborated values of integrity parameters. For example, for each integrity parameter, a yellow range may be pre-set. If one of the integrity parameters has a value or a value difference within its yellow range, the splicing is triggered only if there is at least another different integrity parameter that has a value or a value difference within its yellow range. It may be set that if one of the integrity parameters has a value or a value difference within its yellow range, the splicing is triggered only if there is at least other two different integrity parameters that have values or value differences within their respective yellow ranges. Furthermore, it can be set that only certain combination of integrity parameters, when within their yellow ranges, may trigger splicing. For example, if the elaborated value of the stickiness and of the width of the first sheet are both in their respective yellow ranges, then splicing takes place. However, if the elaborated value of the moisture and stickiness of the first sheet are both in their respective yellow range, no splicing takes place. For example, for each integrity parameter, a red range may be pre-set. If one of the integrity parameters has a value or a value difference within its red range, then splicing takes place, regardless of the value or value difference of the other integrity parameters.

In order to splice the first sheet and the second sheet of material containing alkaloids, the second sheet is unwound from the second bobbin. The second sheet defines a first surface and a second surface. The distance between the first surface and the second surface is the thickness of the second sheet. The second sheet defines a moisture. The second sheet defined a width. The second sheet defines a stickiness.

Any splicing known in the art that connects, preferably stably connects, the first sheet and the second sheet may be used in the present invention. Preferably, the step of splicing includes pressing the first sheet and the second sheet together. Preferably, the step of slicing includes cutting at least the first sheet. The step of cutting may be performed before, after or simultaneously to the step of pressing. Preferably, both the first sheet and the second sheet are cut. For this purpose, the splicing unit may include a blade.

When the first sheet is cut, it defines an end of the first sheet. This end of the first sheet and the head of the second sheet unwound from the second bobbin are preferably spliced. Then, the second sheet is subjected to the same processing the first sheet was subjected to, for example crimping and gathering to form a rod.

In the same way, cutting the first sheet and the second sheet provides a defined end portion of the first sheet and a defined head portion of the second sheet that are to be combined to provide an ongoing continuous sheet of material containing alkaloids.

Preferably, the splicing takes place upstream the portion of the first sheet where the integrity parameters which have triggered the splicing have been evaluated. That is, the splicing is triggered because the evaluated value of one or more of the integrity parameters is for example in its red range. This triggering value has been measured in a specific portion of the first sheet. This means that that a specific portion of the first sheet is possibly not suitable to be further processed to produce final products according to the desired specification, or further processing the first sheet may lead to a rupture in the first sheet and could lead to a machine stop. Therefore, preferably that specific portion of the first sheet is not used in the subsequent processing and the splicing of the first sheet and the second sheet takes place upstream that specific portion. For example, the first sheet is cut upstream of the specific portion. In this way, the portion of the first sheet where "defects" may be present is not used in the subsequent manufacturing steps. The number of final products not fulfilling the production requirements is thus minimized.

The cutting may be performed to the first sheet and to the second sheet in a subsequent manner. Preferably, cutting is performed for both first sheet and second sheet simultaneously. For the cutting process, the first sheet and the second sheet may be arranged next to each other or may overlie each other. Alternatively, each sheet of the first sheet and second sheet is cut independently from the other. Preferably, the first sheet and the second sheet are aligned to lie above each other in a centred manner along a longitudinal central axis of the first sheet and second sheet. As mentioned, the first sheet and second sheet defines locally a plane. Each of the first sheet and second sheet have a width. Preferably, the width of the first sheet and the width of the second sheet are substantially identical. The cutting preferably provides a first cut surface and a second cut surface that provide clearly defined contact areas, where the first sheet and the second sheet may contact each other and may be joined to each other. This supports a good connection between the first sheet and second sheet. The cutting may also be performed at an angle.

The cut is performed at an angle with respect to the width direction. In other words, the width of the first sheet or of the second sheet defines a width direction, which lies on a surface of the first sheet or second sheet. This width direction is perpendicular to the transport direction. The angle between the width direction and the cut line is different from 0 degrees and 90 degrees and preferably is between about 25 degrees and 60 degrees, more preferably between about 30 degrees and 45 degrees.

In order to connect the first sheet and second sheet, preferably on the angled cut surfaces, water is added. Adding water to at least one of the first sheet and second sheet moistens and softens the material of the first sheet or second sheet. While the material of the first sheet or second sheet may have a certain stickiness by itself, such stickiness may be enhanced by adding water. Preferably, water is added to the angled cut surface only, preferably of one sheet only, either the first sheet or the second sheet. By this, the added water may support the combining process of the first sheet and second sheet in the contact area of the sheets without excess water that might negatively affect a connection.

Preferably, pressure is applied to the first sheet and second sheet. For this purpose, the splicing unit may include a compressing device. The subsequently applied force to the first sheet and second sheet, in at least the overlap region formed by the overlapping cut surfaces, provides a strong connection between the two sheets. The pressure may be applied upon the combined sheet, while the combined sheet is stationary or while it further moves along a moving direction. The compressing device may for example comprise a stationary press or for example pressing rollers between which the combined sheet is inserted. The amount of force applied is adapted to provide a good connection, however, preferably without thinning or substantially thinning the first sheet and second sheet in the overlap region.

With the above described splicing, a strong connection may be provided with no additives (other than water) or additional material that might influence taste. In addition, a connection may be provided that has no or has only a reduced effect on processes subsequent to the splicing process in a tobacco sheet processing line. Such subsequent processes may for example be a subsequent crimping process or rod forming process.

With the method of the invention, therefore, interruptions of production are minimized. As soon as the first sheet shows "one or more signs of weakness", depending on the evaluation of these signs as detailed above, splicing takes place, avoiding stopping the production. Furthermore, rejections of final products is also minimized, because as soon as the first sheet shows characteristics which are outside specifications, such as too high moisture, splicing is triggered by the control unit. The resulting production process is therefore faster.

Preferably, the one or more sensors to check the one or more integrity parameters of the first sheet are located between the first bobbin and the splicing unit. Preferably, the signal to trigger the splicing is sent from the control unit to the splicing unit fast enough to cut the first sheet upstream of the specific portion of the first sheet which has been checked by the sensors and which has triggered the splicing, so that the final products are not affected by portion of the first sheet that may be outside specifications.

Furthermore, the normal control of the first bobbin, such as the control of its diameter and the triggering of splicing when the bobbin is almost depleted, is still maintained. Changes to existing systems and programs are thus minimized.

A processing line may be continuously operated at high speed with ongoing constant quality of the product to be manufactured. In addition, any waste material possibly produced may be kept at a minimum.

Preferably, the method includes splicing the first sheet and the second sheet if the diameter of the first bobbin is lower than a given threshold. The splicing takes place in order to avoid stoppage of production. Thus, preferably splicing takes place before the first bobbin is depleted. For example, the diameter of the first bobbin is measured, and when the diameter of the first bobbin is below a given threshold, splicing takes place. The diameter may be measured by a diameter sensor that continuously or at a given frequency measures the diameter of the first bobbin while unwinding. The diameter sensor is connected to the control unit. The control unit may trigger splicing, for example by sending a command signal to the splicing unit, if the signal representative of the value of the diameter of the first bobbin is below a given threshold.

Preferably, the method of the invention includes crimping the first sheet of material including alkaloids unwound from the first bobbin. The first sheet of material containing alkaloids unwound from the first bobbin preferably is subject of further processing steps. For example, the first sheet is crimped. Preferably, the crimping takes place inserting the first sheet of material containing alkaloids between a pair of crimping rollers.

One or more parameters of a portion of the unwound first sheet are evaluated according to the method of the invention. Preferably, the evaluation of the one or more parameters of the first sheet is performed before the crimping of the first sheet.

Preferably, the method of the invention includes gathering the crimped sheet in a rod. After the first sheet has been crimped, preferably it passes through a rod-former where a rod is created, gathering the crimped sheet. The rod is then further processed, for example it is wrapped. The wrapped or unwrapped rod may be used as a component of an aerosol generating article.

Preferably, the method comprises: rejecting the first bobbin after splicing. After splicing, some length of the first sheet remains wound in the first bobbin. This remainder of the first sheet in first bobbin may be discarded, for example in case the value of integrity parameters which triggered splicing indicates that the remaining length of the first sheet in the first bobbin is outside specification. This may take place for example if the first sheet is found to be too sticky or too moist. The remaining first sheet in the first bobbin may be recycled. For example, the remainders of the first bobbin may be reintroduced in a new batch of slurry for the production of another sheet of material containing alkaloids. Alternatively, a predetermined or a to be determined section of the first bobbin is inspected offline and out of specification material removed such that the remainder of the first sheet material on the first bobbin may be reused in another production run if it is within specification.

Preferably, the step of rejecting the first bobbin includes removing the first bobbin from the first shaft. Afterwards, preferably the method comprises inserting a third bobbin in the first shaft. After splicing, the production continues using the second sheet wound in the second bobbin. A third bobbin, formed by a wound third sheet, replaces the first bobbin in the first shaft, so that the second sheet and the third sheet may be spliced, if needed. The sensors used to evaluate or measure one or more of the integrity parameters of the first sheet unwound from the first bobbin are now used to evaluate or measure one or more of the integrity parameter of the third sheet unwound from the third bobbin.

Preferably, the method comprises: buffering a given length of the first sheet of material containing alkaloids before splicing. During the splicing, preferably the speed of the first sheet is reduced with respect to the speed at which the first sheet travels during production. During splicing, the first sheet may be stopped. In order to avoid delays or stoppages of production, preferably before splicing a given length of the first sheet is buffered. This buffered length may be used during the splicing so that production speed is not altered. For example, a buffer system may be used, the buffer system including a plurality of rollers. The amount of buffered first sheet is enough to allow the splicing process without stoppage of production. The buffer system may comprise several rollers which can move, and for this reason are called "movable rollers", toward or away from other rollers which are fixed ("fix rollers"), the sheet passing along these two kind of rollers. However, other systems are envisaged, where all rollers may move towards and away from each other. Rollers are also divided in pairs, the two rollers of the same pair being located substantially at the same height. Furthermore, the pairs of rollers are arranged one on top of the others, forming a matrix of rollers having two column and several rows. The buffer may be formed by vertical sections or horizontal sections of the first sheet. The first sheet of material thus forms a plurality of parallel sections one above the other passing through the various pairs of rollers. The longer these sections are, that is, the bigger the distance between two rollers of the same pair, the more buffering is present. Before splicing, the distance between two rollers of each pair is close to the maximum possible distance. During splicing, the distance between two rollers of each pair decreases, so that the buffered first sheet decreases to cope on one side with the speed of production which remains constant and on the other side with the speed of the first sheet before the splicing unit which is reduced until machine speed is achieved. The buffer rollers of each pair approach each another, decreasing the path travelled by the first sheet in the buffer system and thus providing to the downstream process extra first sheet to compensate the decrease of speed of the first bobbin.

Preferably, the evaluation of the one of more parameters of the first sheet is performed before the buffering of the first sheet.

Preferably, the method comprises: capturing an image of the first sheet of material containing alkaloids. Preferably, the method further comprises determining the width of the first sheet of material containing alkaloids from the image. Preferably, the method further comprises determining the presence or absence of holes or tears in the first sheet of material containing alkaloids from the image. The sensor adapted to measure the width of the first sheet of material or the sensor adapted to detect the presence or absence of holes or tears, or both, may include a camera. The camera is adapted to capture an image of a portion of the first sheet. Preferably, the camera captures an image of a different portion of the first sheet at a given frequency, while the first sheet is transported along the transport direction. Preferably, the frequency at which images of different portions of the first sheet are captured is synchronised with the speed at which the first sheet is unwound from the first bobbin. From the image, using for example standard tool of digital imagining elaboration, the width of the sheet may be determined. For example, the difference in colour between the first sheet and the background may be used. The presence or absence of tears or holes can be evaluated from the image as well. Blob analysis for example could be used. The camera may be a 2-dimensional camera or a line-scan camera.

Preferably, the method comprises: impinging a light beam onto the first sheet of material containing alkaloids. Preferably, the method also comprises: determining the width of the first sheet of material containing alkaloids from a characteristic of the transmitted light beam through the first sheet of material containing alkaloids. Preferably, the method also comprises: determining the thickness of the first sheet of material containing alkaloids from a characteristic of the transmitted light beam through the first sheet of material containing alkaloids. Preferably, the method also comprises: determining the presence or absence of holes or tears in the first sheet of material containing alkaloids from a characteristic of the transmitted light beam through the first sheet of material containing alkaloids. For instance, the sensor adapted to measure the width or the thickness of the first sheet of material containing alkaloids or the sensor adapted to detect the presence or absence of holes or tears in the first sheet of material containing alkaloids may include a light emitter and a light receiver. The light emitter may be located on one side of the first sheet and the light receiver may be located on the opposite side of the first sheet. The light receiver may be for example a photoreceptor. The light emitter may emit a beam of electromagnetic radiation impinging on the first surface of the first sheet. The light receiver may receive the light transmitted through the first sheet. The light transmitted through the first sheet exits the second surface of the first sheet. A width difference may be measured, for example the difference between the actual width and a reference value of width of the first sheet, for which the intensity value of the transmitted light is known. Alternatively, a width difference between the actual width value and a previous width value obtained in a previous measurement taken by the sensor, for which the intensity value of the transmitted light is known. If the width decreases, additional light may pass through the first sheet, so more light is collected by the light receiver. In case of a sensor to detect the presence of holes or tears, the quantity of transmitted light through the first sheet may be evaluated, and for example compared to a reference value of intensity of transmitted light. If the measured value of the intensity of the transmitted light is higher than the reference value, more light may be passing through the first sheet and thus holes or tears may be present. Variations of thickness can be evaluated as well measuring variations of the intensity value of the transmitted light. A thinner section of the first sheet allows more light to pass through it than a thicker section of the first sheet.

Such sensor comprising a light emitter and a light receiver may include a grid of light emitters and a grid of light receivers. The presence of a grid of light emitters and light receivers allows to determine the spatial location of variations in the intensity of the transmitted light. Thus, it may be determined where on the first sheet the increase or decrease in the intensity value of the transmitted light takes place. The spatial accuracy is given by the dimension of the "squares" formed by the grid.

Preferably, the method comprises: measuring the distance between the first sheet of material containing alkaloids and a first sensor. Preferably, the method further comprises: determining the stickiness of the first sheet of material containing alkaloid from the measured distance. The first bobbin is formed by winding the first sheet in coils around a mandrel. The first sheet defines a free portion of the sheet unwound from the first bobbin. The first bobbin also defines a bobbin outer surface. On the bobbin outer surface, a separation line between the free portion of the first sheet and the remaining of the first sheet coiled in the first bobbin is also defined. In order to process the first sheet, the first sheet is unwound. The unwinding takes place pulling it towards a given direction, for example towards downstream unit like a buffer or a crimping unit. The sensors to measure one or more integrity parameters are located between the first bobbin and the downstream unit. The pulling can be performed by suitable pulling rollers. Due to the pulling and the unwinding, the position of the separation line changes, that is, the point of detachment of the first sheet from the first bobbin is moving depending of the adhesion between the last two layers of first sheet in the bobbin. The exact location of the separation lines depends thus on several forces (such as pulling forces and their reaction, the compression force, and others), on the location of the pulling rollers and on the diameter of the first bobbin. If one of these forces or the location of the pulling rollers changes or the diameter of the bobbin changes, also the location of the separation line may change. Furthermore, an angle is defined between the tangent to the outer surface of the bobbin at the contact line and the free portion of the first sheet. This angle depends on the stickiness of the sheet.

If the stickiness of the first sheet becomes "high", preferably higher than a reference value, one of the forces that defines the location of the separation lines changes. Thus, either the location of the contact line, or the width of the angle between the tangent of the outer surface at the separation line and the free portion of the first sheet, or both, may change. If a distance sensor is located in front of a surface of the first sheet, at a location downstream the first bobbin and preferably upstream the splicing unit, the distance between the sensor and the surface of the first sheet varies due to the angle change or separation line's location change. This variation in distance may indicate a variation in the stickiness of the first sheet and may induce the splicing.

Due to the fact that the location of the separation line depends also on the diameter of the first bobbin, preferably also a diameter sensor adapted to measure the diameter of the first bobbin is provided for. The distance sensor and the diameter sensor may send signals representative of the distance between sensor and surface of the first sheet and diameter of the first bobbin, respectively, to the control unit. The control unit may determine the stickiness of the first bobbin using these two signals. The diameter sensor may include a roller pressed on the first bobbin outside surface by a spring, which follows the decreasing diameter of the first bobbin.

Preferably, the method comprises: measuring a force needed to unwind the first sheet of material containing alkaloids from the first bobbin. Preferably, the method further comprises: determining the stickiness of the first sheet of material containing alkaloid from the measured force. Another indication of the stickiness of the first bobbin may be given by a force feedback from the first shaft or from the drive adapted to rotate the first shaft, unwinding the first bobbin. For example, an increase of the torque needed to unwind the first sheet, may indicate a first sheet that is too sticky. Furthermore, a force that is above a safety limit may indicate a tearing of the first sheet.

Preferably, the method comprises: interchanging the position of the first bobbin and the position of the second bobbin after splicing. Preferably, in the first shaft, a new bobbin, such as a third bobbin, to replace the first bobbin, is inserted.

According to another aspect, the invention relates to a system for splicing two sheets of material containing alkaloids, the system comprising: a first shaft adapted to hold in a rotatable manner a first bobbin of a first sheet of material containing alkaloids. The system preferably comprises: a second shaft adapted to hold in a rotatable manner a second bobbin of a second sheet of material containing alkaloids. The system preferably comprises one or more of the following first sheet sensors: a moisture sensor adapted to measure the moisture of the first sheet of material containing alkaloids and to emit a signal on the basis of the moisture measurement; a thickness sensor adapted to measure the thickness of the first sheet of material containing alkaloids and to emit a signal on the basis of the thickness measurement; a width sensor adapted to measure the width of the first sheet of material containing alkaloids and to emit a signal on the basis of the width measurement; a stickiness sensor adapted to measure the stickiness of the first sheet of material containing alkaloids and to emit a signal on the basis of the stickiness measurement; an optical sensor or sound sensor to detect the presence or absence of holes or tears in the first sheet of material containing alkaloids. The system preferably comprises: a splicing unit adapted to splice the first sheet of material containing alkaloids and the second sheet of material containing alkaloids, the splicing unit being located downstream of the one or more first sheet sensors. The system preferably comprises: a control unit connected to the one or more sensors and to the splicing unit, and adapted to activate the splicing unit to splice the first sheet of material containing alkaloids and the second sheet of material containing alkaloids on the basis of the signal emitted by the one or more first sheet sensors.

Advantages of the system of the invention has been already listed with respect to the previous aspect and are not repeated herewith. The control unit receives one or more signals from the one or more first sheet sensors. The first sheet sensors are adapted to measure one or more integrity parameters of the first sheet. Splicing may be determined by the value of a single signal or by the combination of values of two or more signals. The values of the one or more signals may be considered with different weights.

Preferably, the system comprises one or more of the following second sheet sensors: a moisture sensor adapted to measure the moisture of the second sheet of material containing alkaloids and to emit a signal on the basis of the moisture measurement; a thickness sensor adapted to measure the thickness of the second sheet of material containing alkaloids and to emit a signal on the basis of the thickness measurement; a width sensor adapted to measure the width of the second sheet of material containing alkaloids and to emit a signal on the basis of the width measurement; a stickiness sensor adapted to measure the stickiness of the second sheet of material containing alkaloids and to emit a signal on the basis of the stickiness measurement; an optical sensor or sound sensor to detect the presence or absence of holes or tears in the second sheet of material containing alkaloids. Preferably, the same one or more integrity parameters that are measured with reference to the first sheet, are also measured with reference to the second sheet. Thus, the set of one or more sensors which are located upstream the splicing unit and facing the first sheet are preferably duplicated in front of the second sheet. Indeed, when the splicing takes place, the second sheet becomes the sheet which is processed. Therefore, the same care is preferably taken when the second sheet is processed as when the first sheet is processed. Further, preferably the position of the first bobbin and the position of the second bobbin are exchanged and therefore the presence of two set of sensors, one for the first sheet and one for the second sheet, allows such a swap without consequences in the quality of the processing of the first sheet or of the second sheet.

Preferably, the stickiness sensor is a distance sensor or a force sensor.

Preferably, the width sensor is an optical sensor including a light source.

Preferably, the system comprises a bobbin holder comprising the first shaft and the second shaft, the bobbin holder being adapted to interchange the position of the first shaft and the second shaft. For example, the bobbin holder may include a rotating disk and the first shaft and the second shaft may extend from the same face of the disk. Rotations of the disk may allow the interchange between the positions of the shafts.

Preferably, the system comprises a buffer adapted to buffer a variable amount of the first sheet of material containing alkaloids or of the second sheet of material containing alkaloids, the buffer being located downstream the splicing unit. The buffer preferably comprise movable rollers to change the amount of buffered first sheet or second sheet.

Preferably, the system comprises a drying unit for drying the spliced sheet. Preferably, the drying is provided in at least the overlapping region or in the region where water has been applied to the first sheet or second sheet, or to both. Drying may support a splicing process by speeding up the process of removing any water that had been dispensed to the first sheet or second sheet before joining the first sheet and second sheet. Preferably, a drying unit comprises a heater, for example based on hot air or on infrared heating. The heater is located downstream the splicing unit.

Further, preferably the first sheet or the second sheet is crimped. Preferably, the system includes a crimping unit. Crimping is preferably performed using a pair of crimping rollers, denoted as first crimping roller and second crimping roller. The first crimping roller and second crimping roller are positioned one adjacent to the other and a nip is formed between the first crimping roller and the second crimping roller. The first sheet or the second sheet is inserted in the nip in order to be crimped. The first crimping roller defines a first rotational axis and a first outer surface. The second crimping roller defines a second rotational axis and a second outer surface. The first rotational axis and the second rotational axis are preferably parallel to each other. The first rotational axis and second rotational axis are preferably horizontal. At least one of the first crimping roller or second crimping roller includes corrugations. Preferably, the corrugations are formed on the first outer surface or on the second outer surface. Preferably, the corrugations are formed in both the first outer surface and in the second outer surface. The corrugations on the crimping rollers come into contact with the first sheet or the second sheet when the first sheet or second sheet is inserted into the nip between the first crimping roller and second crimping roller. Due to the corrugations' action on the first sheet or second sheet, corresponding corrugations are formed on the first sheet or second sheet when it passes through the nip. In case both first crimping roller and second crimping roller include corrugations, the crimping rollers may be designed and arranged in a way that at least some of their corrugations substantially interleave.

Preferably, the crimped first sheet or the crimped second sheet are gathered to form a rod. Preferably, the rod is formed using a rod former. The so formed rod is preferably used as a component of an aerosol generating article.

As used herein, the term "sheet" denotes a laminar element having a width and length substantially greater than the thickness thereof. The width of the sheet of material containing alkaloids is preferably greater than about 10 millimeters, more preferably greater than about 20 millimeters or about 30 millimeters. Even more preferably, the width of the sheet of material containing alkaloids is comprised between about 60 millimeters and about 2500 millimeters. The thickness of the sheet of material containing alkaloids is preferably comprised between about 50 micrometers and about 300 micrometers, more preferably the thickness of the sheet is comprised between about 100 micrometers and about 250 micrometers, even more preferably between about 190 micrometers and 220 micrometers.

"Aerosol-generating articles" according to the present invention may be in the form of articles in which an alkaloids containing material, such as a tobacco material, is heated to form an aerosol, rather than combusted, and articles in which an alkaloids-containing aerosol is generated from an alkaloids-containing material, for example from a tobacco extract, or other nicotine source, without combustion or heating. Aerosol-generating articles according to the invention may be whole, assembled aerosol forming articles or components of aerosol-generating articles that are combined with one or more other components in order to provide an assembled article for producing an aerosol, such as for example, the consumable part of a heated smoking device.

A "material containing alkaloids" is a material which contains one or more alkaloids. The alkaloids may comprise nicotine. The nicotine may be found, for example, in tobacco.

Alkaloids are a group of naturally occurring chemical compounds that mostly contain basic nitrogen atoms. This group also includes some related compounds with neutral and even weakly acidic properties. Some synthetic compounds of similar structure are also termed alkaloids. In addition to carbon, hydrogen and nitrogen, alkaloids may also contain oxygen, sulfur and, more rarely, other elements such as chlorine, bromine, and phosphorus.

Alkaloids are produced by a large variety of organisms including bacteria, fungi, and plants. They can be purified from crude extracts of these organisms by acid-base extraction. Caffeine, nicotine, theobromine, atropine, tubocurarine are examples of alkaloids.

The term "homogenized tobacco material" is used to encompass any tobacco material formed by the agglomeration of particles of tobacco material. Sheets of homogenized tobacco are formed in the present invention by agglomerating particulate tobacco obtained by grinding or otherwise powdering of one or both of tobacco leaf lamina and tobacco leaf stems. The material containing alkaloids can thus be a homogenized tobacco material, which contains the alkaloid nicotine.

In addition, homogenized tobacco material may comprise a minor quantity of one or more of tobacco dust, tobacco fines, and other particulate tobacco by-products formed during the treating, handling and shipping of tobacco.

Homogenized tobacco material may comprise one or more intrinsic binders, one or more extrinsic binders, or a combination thereof to help agglomerate particles of tobacco. Homogenised tobacco material may also comprise an aerosol-former. Homogenized tobacco material may comprise other additives including, but not limited to, tobacco and non-tobacco fibres, humectants, plasticisers, flavourants, fillers, aqueous and non-aqueous solvents, and combinations thereof.

In the present invention, the homogenized tobacco material comprises tobacco lamina and stem of different tobacco types, which are properly blended. With the term "tobacco type" one of the different varieties of tobacco is meant. With respect to the present invention, these different tobacco types are distinguished in three main groups of bright tobacco, dark tobacco and aromatic tobacco. The distinction between these three groups is based on the curing process the tobacco undergoes before it is further processed in a tobacco product.

Bright tobaccos are tobaccos with a generally large, light coloured leaves. Throughout the specification, the term "bright tobacco" is used for tobaccos that have been flue cured. Examples for bright tobaccos are Chinese Flue-Cured, Flue-Cured Brazil, US Flue-Cured such as Virginia tobacco, Indian Flue-Cured, Flue-Cured from Tanzania or other African Flue Cured. Bright tobacco is characterized by a high sugar to nitrogen ratio. From a sensorial perspective, bright tobacco is a tobacco type which, after curing, is associated with a spicy and lively sensation. According to the invention, bright tobaccos are tobaccos with a content of reducing sugars of between about 2.5 percent and about 20 percent on dry weight basis of the leaf and a total ammonia content of less than about 0.12 percent on dry weight basis of the leaf. Reducing sugars comprise for example glucose or fructose. Total ammonia comprises for example ammonia and ammonia salts.

Dark tobaccos are tobaccos with a generally large, dark coloured leaves. Throughout the specification, the term "dark tobacco" is used for tobaccos that have been air cured. Additionally, dark tobaccos may be fermented. Tobaccos that are used mainly for chewing, snuff, cigar, and pipe blends are also included in this category. From a sensorial perspective, dark tobacco is a tobacco type which, after curing, is associated with a smoky, dark cigar type sensation. Dark tobacco is characterized by a low sugar to nitrogen ratio. Examples for dark tobacco are Burley Malawi or other African Burley, Dark Cured Brazil Galpao, Sun Cured or Air Cured Indonesian Kasturi. According to the invention, dark tobaccos are tobaccos with a content of reducing sugars of less than about 5 percent of dry weight base of the leaf and a total ammonia content of up to about 0.5 percent of dry weight base of the leaf.

Aromatic tobaccos are tobaccos that often have small, light coloured leaves. Throughout the specification, the term "aromatic tobacco" is used for other tobaccos that have a high aromatic content, for example a high content of essential oils. From a sensorial perspective, aromatic tobacco is a tobacco type which, after curing, is associated with spicy and aromatic sensation. Example for aromatic tobaccos are Greek Oriental, Oriental Turkey, semi-oriental tobacco but also Fire Cured, US Burley, such as Perique, Rustica, US Burley or Meriland.

Additionally, a blend may comprise so called filler tobaccos. Filler tobacco is not a specific tobacco type, but it includes tobacco types which are mostly used to complement the other tobacco types used in the blend and do not bring a specific characteristic aroma direction to the final product. Examples for filler tobaccos are stems, midrib or stalks of other tobacco types. A specific example may be flue cured stems of Flue Cured Brazil lower stalk.

Preferably, the homogenized tobacco material comprises a binder. Preferably, the amount of binder is between about 1 percent and about 5 percent in dry weight basis of the homogenized tobacco material. It is advantageous to add a binder, such as any of the gums or pectins described herein, to ensure that the tobacco powder remains substantially dispersed throughout the homogenized tobacco sheet. For a descriptive review of gums, see Gums And Stabilizers For The Food Industry, IRL Press (G. O. Phillip et al. eds. 1988); Whistler, Industrial Gums: Polysaccharides And Their Derivatives, Academic Press (2d ed. 1973); and Lawrence, Natural Gums For Edible Purposes, Noyes Data Corp. (1976).

Although any binder may be employed, preferred binders are natural pectins, such as fruit, citrus or tobacco pectins; guar gums, such as hydroxyethyl guar and hydroxypropyl guar; locust bean gums, such as hydroxyethyl and hydroxypropyl locust bean gum; alginate; starches, such as modified or derivitized starches; celluloses, such as methyl, ethyl, ethylhydroxymethyl and carboxymethyl cellulose; tamarind gum; dextran; pullalon; konjac flour; xanthan gum and the like. The particularly preferred binder for use in the present invention is guar.

Advantageously, the homogenized tobacco material comprises an aerosol-former. Preferably, the aerosol-formed is comprised in amount between about 5 percent and about 30 percent dry weight of the aerosol former.

Suitable aerosol-formers for inclusion in slurry for webs of homogenised tobacco material are known in the art and include, but are not limited to: monohydric alcohols like menthol, polyhydric alcohols, such as triethylene glycol, 1,3-butanediol and glycerine; esters of polyhydric alcohols, such as glycerol mono-, di- or triacetate; and aliphatic esters of mono-, di- or polycarboxylic acids, such as dimethyl dodecanedioate and dimethyl tetradecanedioate.

For example, where the homogenized tobacco material according to the specification is intended for use as aerosol-forming substrates in heated aerosol-generating articles, sheets of homogenised tobacco material may have an aerosol former or humectant content of between about 5 percent and about 30 percent by weight on a dry weight basis, preferably between about 15 percent and about 20 percent. Homogenized tobacco material intended for use in electrically-operated aerosol-generating system having a heating element may preferably include an aerosol former of greater than 5 percent to about 30 percent. For homogenized tobacco material intended for use in electrically-operated aerosol-generating system having a heating element, the aerosol former may preferably be glycerol.

With the term "stickiness", reference is made to the adhesive properties or cohesive properties of the sheet. Adhesion is the tendency of dissimilar particles or surfaces to cling to one another, while cohesion refers to the tendency of similar or identical particles or surfaces to cling to one another. The stickiness of a sheet may be measured using a LIDAR (Laser Imaging Detection and Ranging) adapted to measure a distance between the measuring apparatus and a sheet which is unwounded from a roller. The LIDAR is positioned in such a way to face the unwound portion of the sheet. A "not-sticky" sheet has the closest distance to the LIDAR, because the unwound portion of the sheet immediately detaches from the roller. The distance between LIDAR and unwound portion of the sheet increases with increasing stickiness.

In the following, with the term "upstream" or "downstream", reference is made to the direction of motion or transport of the sheet.

As used herein, the terms "gathered" or "gathering" when referred to a sheet denote that a sheet is convoluted, or otherwise compressed or constricted substantially transversely to the transport direction of the sheet into rod form.

As used herein, the terms "horizontal" and "vertical" have their standard meaning.

The invention is defined in the claims. However, below there is provided a non-exhaustive list of non-limiting examples. Any one or more of the features of these examples may be combined with any one or more features of another example, embodiment, or aspect described herein.

Example Ex1: A method for splicing two sheets of material containing alkaloids, the method comprising:

- providing a first sheet of material containing alkaloids wound in a first bobbin;
- providing a second sheet of material containing alkaloids wound in a second bobbin;
- unwinding the first sheet of material containing alkaloids wound in the first bobbin;
- evaluating one or more of the following parameters of the unwound first sheet of material containing alkaloids:
  - moisture of the first sheet of material containing alkaloids;
  - thickness of the first sheet of material containing alkaloids;
  - width of the first sheet of material containing alkaloids;
  - stickiness of the first sheet of material containing alkaloids;
  - presence or absence of holes or tears in the first sheet of material containing alkaloids;
- and, depending on the value of the evaluated one or more parameters, unwinding the second sheet of material containing alkaloids wound in the second bobbin;
- splicing the first sheet of material containing alkaloids and the second sheet of material containing alkaloids.

Example Ex2: The method according to Ex1, comprising:

- rejecting the first bobbin after splicing.

Example Ex3: The method according to Ex1 or Ex2, comprising:

- buffering a given length of the first sheet of material containing alkaloids before splicing.

Example Ex4: The method according to one or more of the preceding Ex1-Ex3, comprising:

- capturing an image of the first sheet of material containing alkaloids;
- determining the width of the first sheet of material containing alkaloids or the presence or absence of holes or tears in the first sheet of material containing alkaloids from the image.

Example Ex5: The method according to one or more of the preceding Ex1-Ex4, comprising:

- impinging a light beam onto the first sheet of material containing alkaloids;
- determining the width or the thickness of the first sheet of material containing alkaloids or the presence or absence of holes or tears in the first sheet of material containing alkaloids from a characteristic of the transmitted light beam through the first sheet of material containing alkaloids.

Example Ex6: The method according to one or more of the preceding Ex1-Ex5, comprising:

- measuring the distance between the first sheet of material containing alkaloids and a first sensor;
- determining the stickiness of the first sheet of material containing alkaloid from the measured distance.

Example Ex7: The method according to one or more of the preceding Ex1-Ex6, comprising:

- measuring a force needed to unwind the first sheet of material containing alkaloids from the first bobbin;
- determining the stickiness of the first sheet of material containing alkaloid from the measured force.

Example Ex8: The method according to one or more of the preceding Ex1-Ex7, comprising:

- interchanging the position of the first bobbin and the position of the second bobbin after splicing.

Example Ex9: The method according to one or more of the preceding Ex1-Ex8, comprising: wetting with water the first sheet or the second sheet before splicing.

Example Ex10: The method according to one or more of the preceding Ex1-Ex9, comprising:

- drying the first sheet or the second sheet after splicing.

Example Ex11: The method according to one or more of the preceding Ex1-Ex10, comprising:

- crimping the first sheet or the second sheet.

Example Ex12: The method according to one or more of the preceding Ex1-Ex11, comprising:

- forming a rod from the crimped sheet.

Example Ex13: A method of forming an aerosol generating article, the method comprising incorporating in the aerosol generating article one or more of the rod formed according to Ex12.

Example Ex14: The method according to one or more of the preceding Ex1-Ex13, comprising: measuring the diameter of the first bobbin while unwinding.

Example Ex15: The method according to Ex14, comprising:

splicing the first sheet and the second sheet if the diameter of the first bobbin is lower than a given threshold.

Example Ex16: A system for splicing two sheets of material containing alkaloids, the system comprising:

a first shaft adapted to hold in a rotatable manner a first bobbin of a first sheet of material containing alkaloids;

a second shaft adapted to hold in a rotatable manner a second bobbin of a second sheet of material containing alkaloids;

one or more of the following first sheet sensors:

a moisture sensor adapted to measure the moisture of the first sheet of material containing alkaloids and to emit a signal on the basis of the moisture measurement;

a thickness sensor adapted to measure the thickness of the first sheet of material containing alkaloids and to emit a signal on the basis of the thickness measurement;

a width sensor adapted to measure the width of the first sheet of material containing alkaloids and to emit a signal on the basis of the width measurement;

a stickiness sensor adapted to measure the stickiness of the first sheet of material containing alkaloids and to emit a signal on the basis of the stickiness measurement;

an optical sensor or sound sensor to detect the presence or absence of holes or tears in the first sheet of material containing alkaloids;

a splicing unit adapted to splice the first sheet of material containing alkaloids and the second sheet of material containing alkaloids, the splicing unit being located downstream the one or more first sheet sensors;

a control unit connected to the one or more sensors and to the splicing unit, and adapted to activate the splicing unit to splice the first sheet of material containing alkaloids and the second sheet of material containing alkaloids on the basis of the signal emitted by the one or more first sheet sensors.

Example Ex17: The system according to Ex16 comprising one or more of the following second sheet sensors:

a moisture sensor adapted to measure the moisture of the second sheet of material containing alkaloids and to emit a signal on the basis of the moisture measurement;

a thickness sensor adapted to measure the thickness of the second sheet of material containing alkaloids and to emit a signal on the basis of the thickness measurement;

a width sensor adapted to measure the width of the second sheet of material containing alkaloids and to emit a signal on the basis of the width measurement;

a stickiness sensor adapted to measure the stickiness of the second sheet of material containing alkaloids and to emit a signal on the basis of the stickiness measurement;

an optical sensor or sound sensor to detect the presence or absence of holes or tears in the second sheet of material containing alkaloids.

Example Ex18: The system according to Ex16 or Ex17, wherein the stickiness sensor is a distance sensor or a force sensor.

Example Ex19: The system according to one or more of Ex16-Ex18, wherein the width sensor is an optical sensor including a light source.

Example Ex20: The system according to one or more of Ex16-Ex19, comprising a bobbin holder comprising the first shaft and the second shaft, the bobbin holder being adapted to interchange the position of the first shaft and the second shaft.

Example Ex21: The system according to one or more of Ex16-Ex20, comprising a buffer adapted to buffer a variable amount of the first sheet of material containing alkaloids or of the second sheet of material containing alkaloids, the buffer being located downstream the splicing unit.

Example Ex22: The system according to one or more of Ex16-Ex21, wherein the splicing unit comprises a blade to cut the first sheet or the second sheet.

Example Ex23: The system according to one or more of Ex16-Ex22, wherein the splicing unit comprises a dryer to dry the first sheet or the second sheet.

Example Ex24: The system according to one or more of Ex16-Ex23, comprising a crimper.

Example Ex25: The system according to one or more of Ex16-Ex24, comprising a rod former.

Examples will now be further described with reference to the figures in which:

FIG. 10 is a top view of a first sheet;

FIG. 11 is a top view of the first sheet of FIG. 10 in a phase of the method of the invention;

FIG. 12 is a top view of a second sheet;

FIG. 13 is a top view of the second sheet of FIG. 12 in a phase of the method of the invention;

FIG. 14 is a top view of a processed first sheet of FIGS. 10 and 11 in a further step of the invention;

Figure 1:
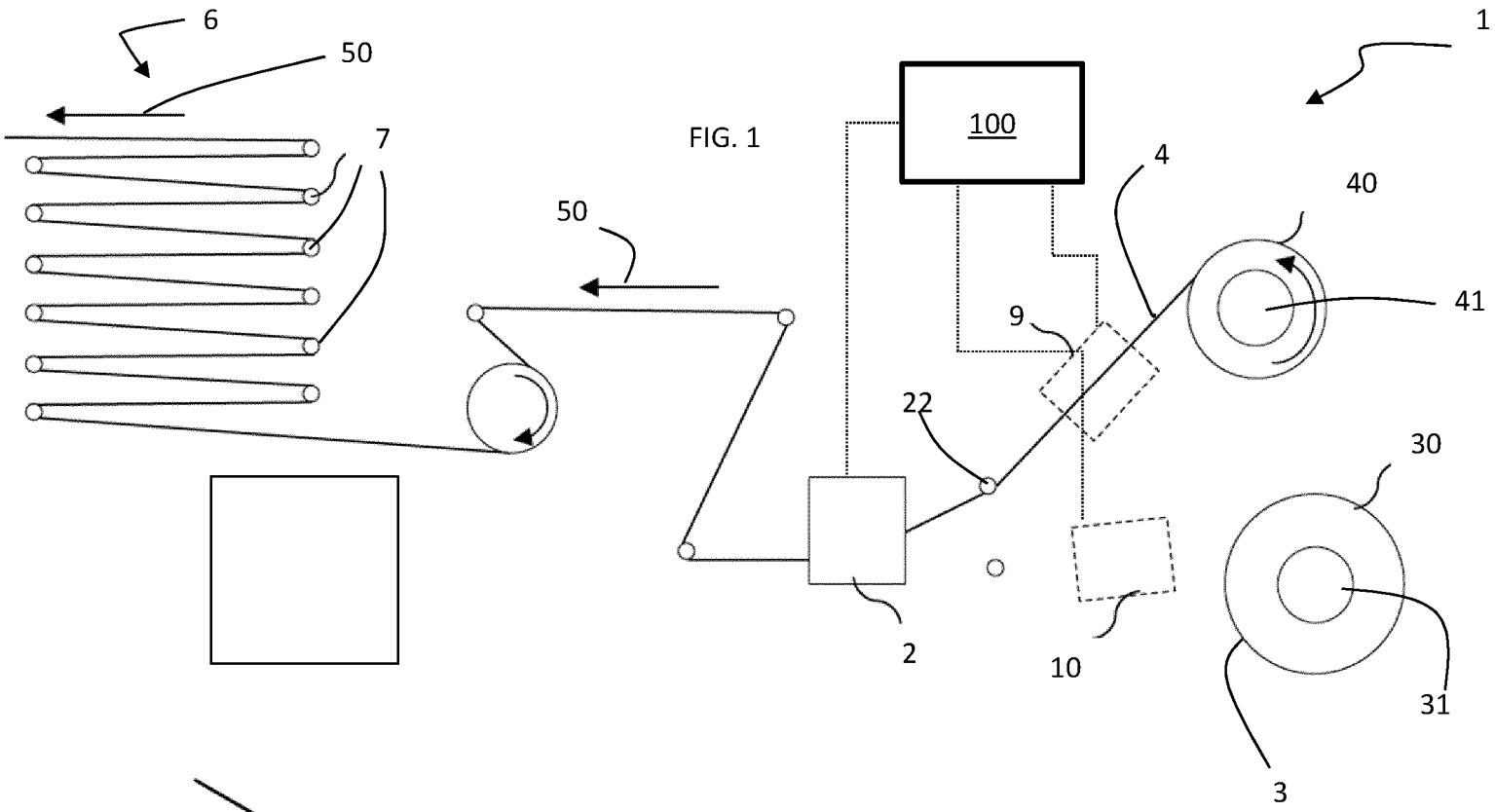
FIG. 1 is a schematic lateral view of a system to splice a first sheet and a second sheet according to the invention.
Figure 8:
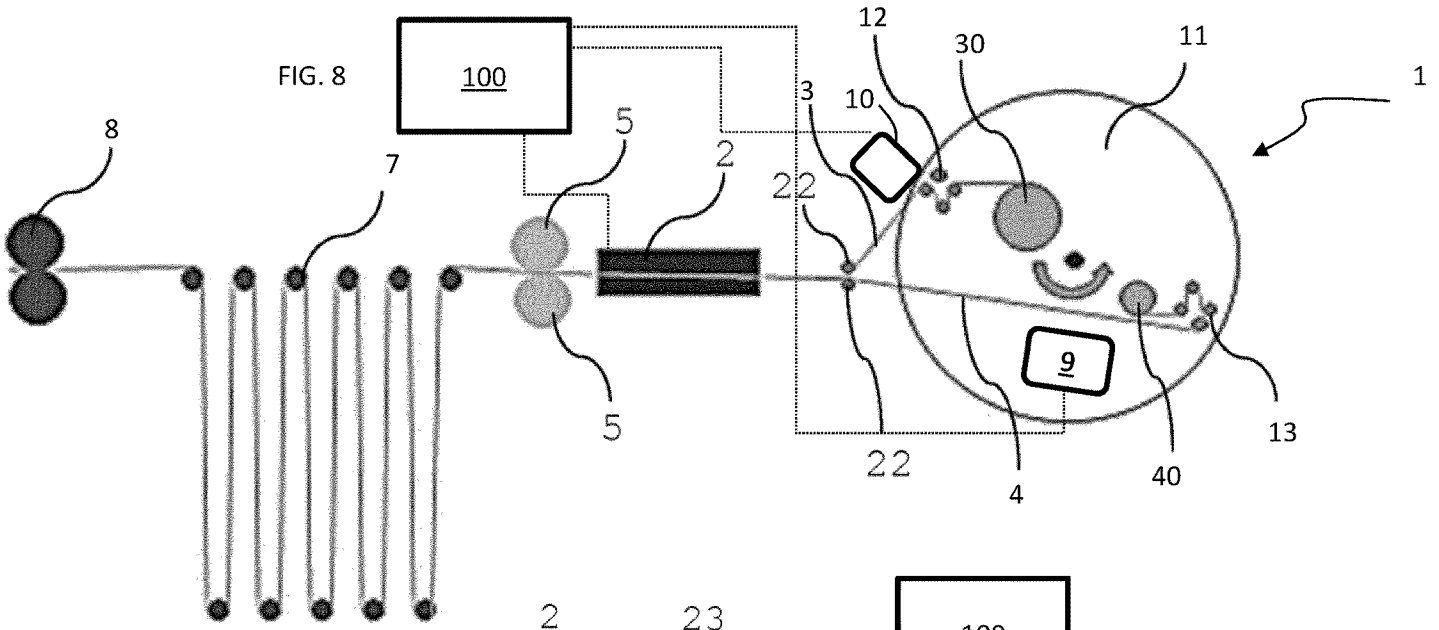
FIG. 8 is a more detailed lateral view of a portion of the system of FIG. 1.

With initial reference to FIGS. 1 and 8, a system to splice a first sheet and a second sheet of material containing alkaloids is globally indicated with 1.

The system 1 comprises a first shaft 41 and a second shaft 31, on which a first bobbin 40 and a second bobbin 30 are respectfully inserted. The first shaft 41 and second shaft 31 are rotatable around their respective axis (not shown in the drawings). The first bobbin 40 supplies the first sheet of material 4 and the second bobbin 30 supplies the second sheet 3 of material. Preferably, the first sheet 4 and the second sheet 3 are homogenised tobacco sheets.

In FIG. 8, the system 1 includes a rotatable bobbin holder 11. The rotatable bobbin holder 11 includes the first shaft 41 and the second shaft 31, extending from the bobbin holder 11. The bobbin holder 11 is thus provided with the two bobbins 30,40 carrying the two sheets 3,4.

The system 1 further comprises a splicing unit 2, schematically indicated with a rectangle in FIGS. 1 and 8. The first sheet 4, which in FIGS. 1 and 8 is the sheet in use, is supplied to the splicing unit 2. The unwinding of the first sheet 4 from the first bobbin 40 and its supply to the splicing unit 2 takes place via guide pulley 22. The first sheet 4 is transported towards the splicing unit 2 and in the further processing stages along a transport direction which is indicated by the arrow 50.

Downstream of the splicing unit 2, the system 1 comprises an acceleration unit in the form of two acceleration rollers 5 (visible in FIG. 8). The first sheet and second sheet (detailed below) being passed through the splicing unit 2 may be accelerated or slowed down by the acceleration unit 5. The first sheet 4 or second sheet 3 may be continuously accelerated upon passing between the two acceleration rollers 5 in order to secure a continuous velocity of the sheet. Preferably, for the splicing process, the sheet may be decelerated or stopped by the acceleration rollers 5. After a splicing process, the spliced sheet may be accelerated again to a process velocity.

Downstream the acceleration rollers 5, the system 1 comprises a buffer system 6. The buffer system 6 comprises a plurality of rollers, all indicated with 7, such as a series of idler pulleys, where the first sheet 4 or the second sheet 3 is guided around and forms loops. Some of the idler pulleys 7 are arranged in a movable manner such as to enlarge or shorten a sheet loop in order to be able to further provide sheet material in a downstream direction, even when a supply from the splicing unit 2 or from the first bobbin 40 or second bobbin 30 is interrupted or reduced.

Downstream of the buffer system 6 a pulling unit 8 (visible only in FIG. 8) pulls the first sheet 4 or the second sheet 3 out of the buffer system 6 to pass the sheet preferably at a constant velocity to further downstream arranged sheet processing units (not visible).

Further elements and units may be included in the system 1, such as a crimper and a rod former (not shown in the drawings), both located downstream the buffer system 6 and pulling unit 8.

Between the first shaft 41 and the splicing unit 2, along the path taken by the first sheet 4 along the transport direction 50, at least a first sheet sensor 9 is located in the system 1. Sensor 9 is schematically depicted as a rectangle in FIGS. 1 and 8. The sensor 9 may be a thickness sensor. The sensor 9 may be a width sensor. The sensor 9 may be a moisture sensor. The sensor 9 may be stickiness sensor. The sensor 9 may be a detector for the presence or absence of holes or tears in the first sheet 4.

Figure 6:
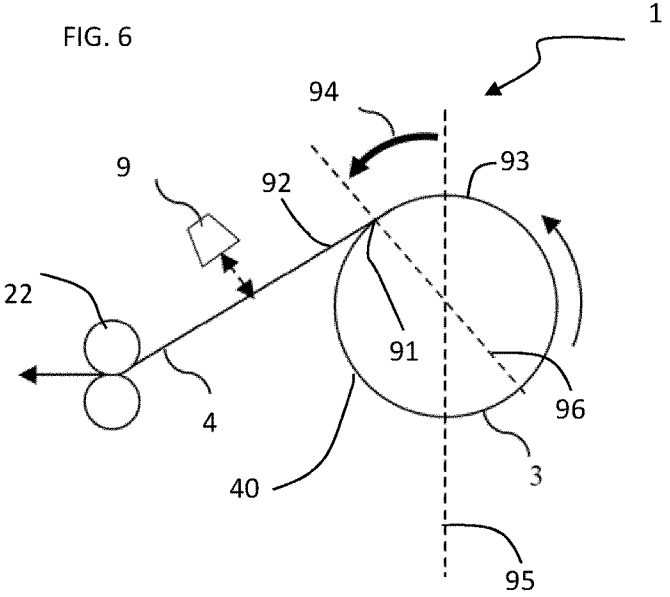
FIG. 6 and FIG. 7 are two lateral views of a detail of an embodiment of the system of FIG. 1.
Figure 7:
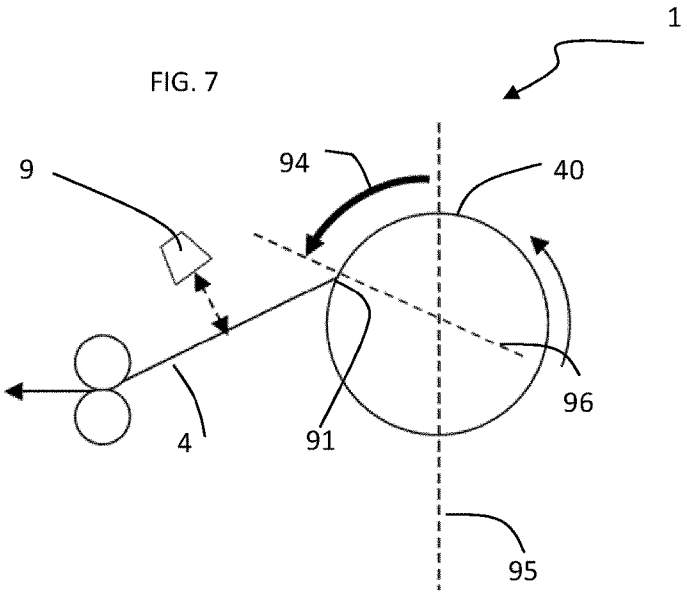

As example of first sheet sensor 9 is depicted in FIGS. 6 and 7. The sensor 9 is a stickiness sensor, comprising a distance sensor. In FIG. 6, the first sheet 4 is unwound from first bobbin 40. The first sheet defines a separation line 91 between the free end 92 of the first sheet which is already unwound from the first bobbin 40 and the remaining first sheet 93 still wound in the first bobbin 40. An angle 94 is formed between a vertical plane 95 passing through the rotational axis of the first shaft 41 and perpendicular to the same, and a plane 96 passing through the rotational axis of the first shaft 41 (and perpendicular to the same) and the separation line 91. With a given angle 94, the distance measured by sensor 9 has a given value. If the stickiness of the first sheet 4 changes, and in particular increases, the distance between sensor and sheet changes (as well as angle 94), as depicted in FIG. 7. In this way a change in stickiness of the first sheet 4 can be measured.

Between the second shaft 31 and the splicing unit 2, along the path taken by the second sheet 3, at least a second sheet sensor 10 is located in the system 1, schematically depicted as a rectangle in FIGS. 1 and 8. The sensor 10 may be a thickness sensor. The sensor 10 may be a width sensor. The sensor 10 may be a moisture sensor. The sensor 10 may be stickiness sensor. The sensor 10 may be a detector for the presence or absence of holes or tears in the second sheet 3. First sheet sensor 9 and second sheet sensor 10 may be the same type of sensor. First sheet sensor 9 and second sheet sensor 10 may measure the same integrity parameter of the first sheet 4 and second sheet 3, respectively.

System 1 further include a control unit 100. Control unit 100 is connected to first sheet sensor 9, second sheet sensor 10 and the splicing unit 2. Preferably, control unit is also connected to bobbin holder 11, buffer system 6, and acceleration unit 5 to command the same. Some of the connections are visible in the figures as dotted lines. Not all connections are depicted for clarity of the figures.

Figure 9:
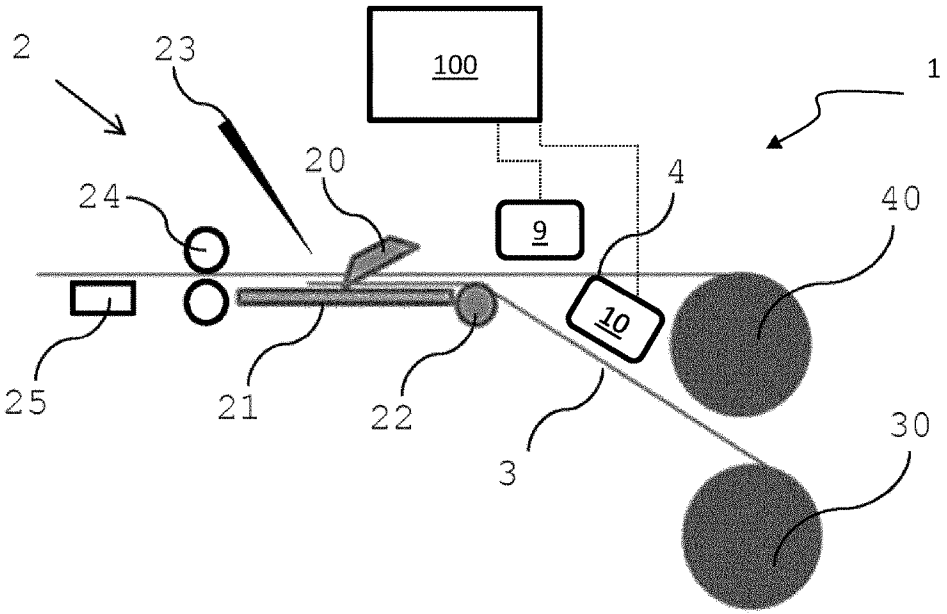
FIG. 9 is a more detailed view of another portion of the system of FIG. 1.

With now reference to FIG. 9, the splicing unit 2 is shown in details. Sone parts of the system 1, such as the buffer system 6, are not shown in FIG. 9. Splicing unit 2 includes a cutting knife 20 to cut the first sheet 4 or the second sheet 3 or both. The splicing unit 2 further includes a dispensing unit 23 adapted to dispense water onto the first sheet 4 or second sheet 3. The splicing unit 2 also includes compressing rollers 24 to compress the spliced first sheet and second sheet. The splicing unit 2 comprises preferably also a heating unit 25, for example a hot air source or a heat radiating source, arranged downstream adjacent the compressing rollers 24.

The functioning of the system 1 is as follow.

In FIG. 1 the first tobacco sheet 4, unwound from the first bobbin 40, is in use and is passing in a substantially straight direction through the splicing unit 2. No processing takes place in the splicing unit. The first sheet 4 is then buffered for a given length in the buffer system 6 and it is further transported to sheet processing units arranged further downstream (not shown). Such processing units may for example be a crimping unit or a rod forming unit.

While travelling towards the splicing unit 2, the sensor 9 evaluate one or more integrity parameters of the first sheet, at a given frequency, checking the surface of the first sheet while the first sheet travels along the transport direction 50. Signals representative of the integrity parameters are sent to the control unit 100 where they are elaborated, for example compared to a threshold.

Figure 3:
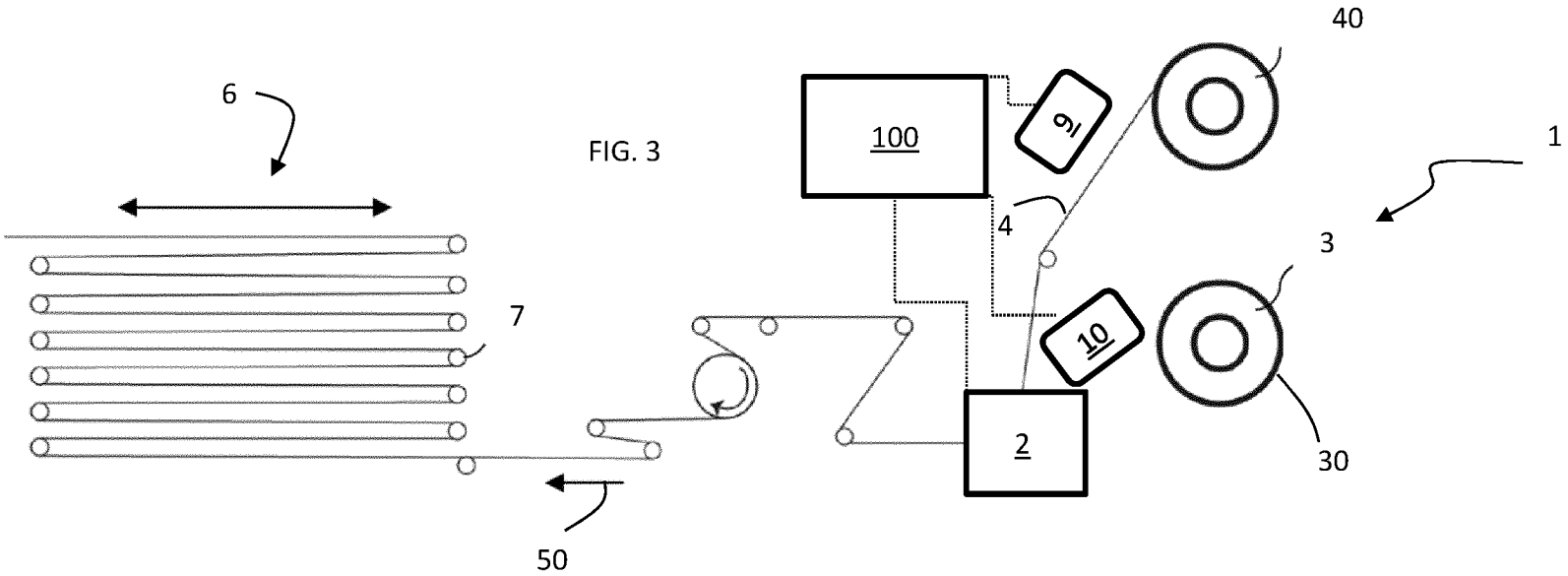
FIG. 3 and FIG. 4 are two schematic lateral view of two operative positions of the system of FIG. 1.

In this situation, the buffer system 6 is buffering a maximum length of the first sheet 4, as depicted in the configuration of the system 1 depicted in FIG. 3. The rollers 7 are distanced at the maximum distance one from the other. This distance can be along a horizontal direction (see FIG. 3) or a vertical direction (see FIG. 8).

Figure 5:
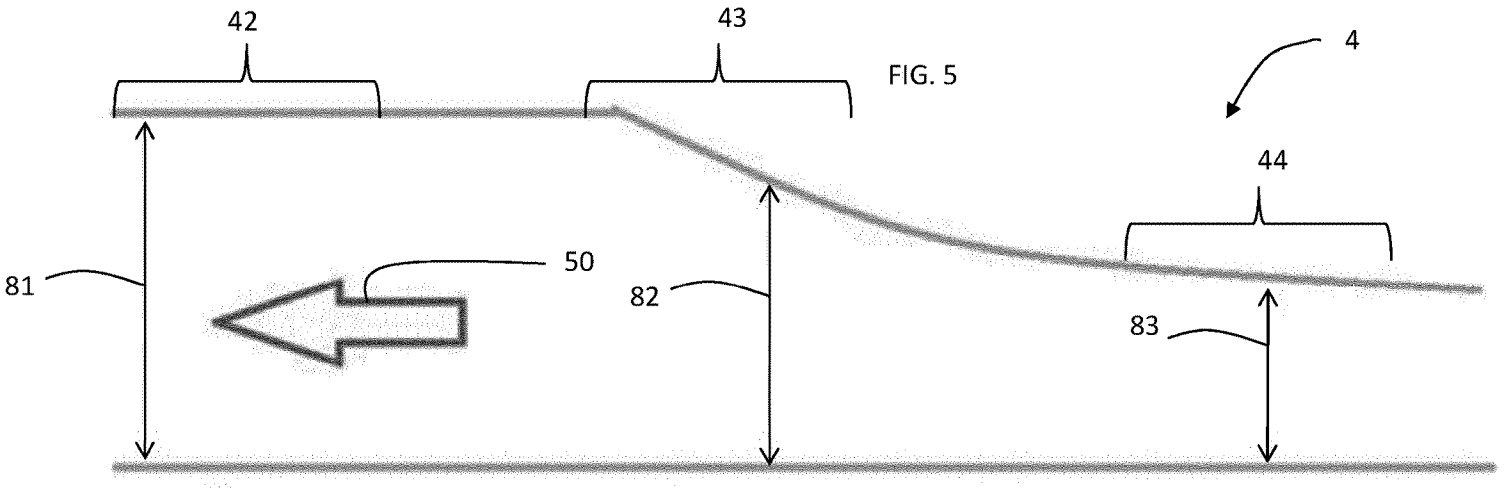
FIG. 5 is a lateral view of a first sheet presenting a defect.

For example, the sensor 9 is a thickness sensor. The sensor 9 measures the thickness of the first sheet 4 at a given frequency. As shown in FIG. 5, where a section of the first sheet 4 is shown along a plane containing the transport direction 50, the sensor 9 measures a first thickness 81 in a first portion 42 of the first sheet 4 at a time t1. The thickness 82 is then compared by the control unit 100 with a threshold and it results within the acceptable range, such as in a green range. At a subsequent time t2, the first sheet 4 has moved and thus the sensor 9 can measure the thickness 82 of the first sheet 4 in a second portion 43. The thickness 82 is then compared by the control unit 100 with a threshold. For example, it is found that the results are not within the acceptable range, but not very far from the acceptable range. Then the control unit 100 considers the value to be in a yellow range. At a subsequent time t3, the first sheet 4 has moved again and the sensor 9 can measure the thickness 83 of the first sheet 4 in a third portion 44. The thickness 83 is then compared by the control unit 100 with a threshold. For example, it is found that the results are not within the acceptable range, that is, the value 83 is in a red range. This is considered to be a non-acceptable defect of the first sheet 4 and the control unit 100 commands the splicing unit 2 to start the splicing.

Figures 15, 16:
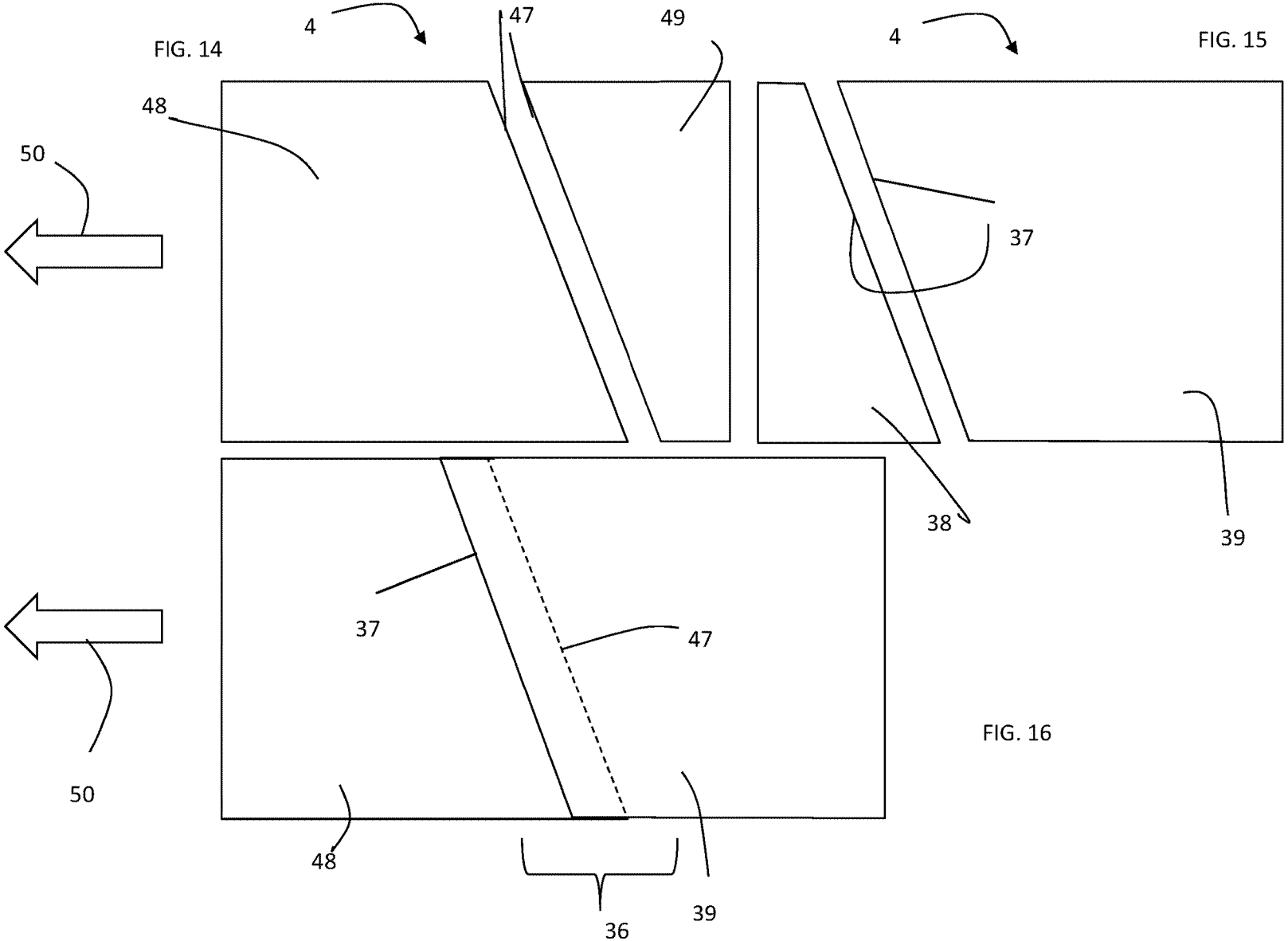
FIG. 15 is a top view of a processed second sheet of FIGS. 12 and 13 in a further step of the invention.
FIG. 16 is a top view of a further steps of the invention of the splicing of the first and the second sheet of FIGS. 14 and 15.

The second sheet 3 from the second bobbin 30 is guided via guide pulley 22 and supplied to the splicing unit 2 (in FIG. 9, the second sheet 3 is supplied from below first sheet 4 in use). Both sheets 3,4 are arranged on top of each other and aligned on a support surface 21 of the splicing unit 2. They are then cut under a cutting angle α by cutting knife 20 (depicted for example in FIG. 2). This operation is better detailed in FIG. 10 to FIG. 13. The first sheet 4 travelling along the transport direction 50 (see the top view of FIG. 10) is cut along a cut line 47, as shown in FIG. 11. The cut line forms an angle different from 0 degrees or 90 degrees with the transport direction. The second sheet 3 travelling along the transport direction 50 (see the top view of FIG. 12) is cut along a cut line 37, as shown in FIG. 13. The cut line forms an angle different from 0 degrees or 90 degrees with the transport direction. Cut lines 37 and 47 are preferably congruent when the first sheet and second sheet are overlapping. By the cut line 47, a clearly defined end portion 48 of the first sheet 4 and a waste portion 49 of the first sheet are defined, as shown in FIG. 14. By the cut line 37, a clearly defined waste portion 38 of the second sheet 3 and a head portion 39 of the second sheet 3 are defined, as shown in FIG. 15.

Figure 2:
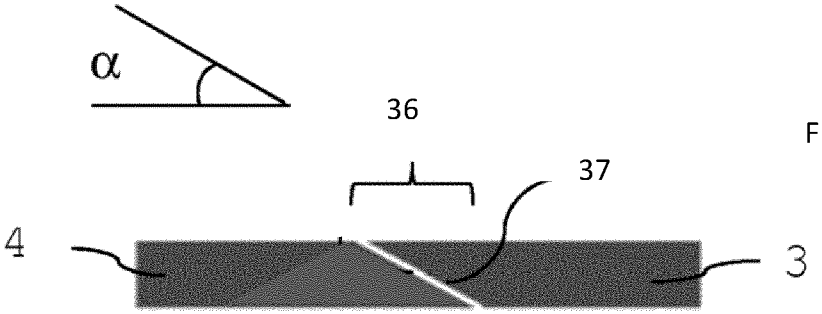
FIG. 2 is a schematic top view of a first sheet and a second sheet spliced by the system of FIG. 1.
Figure 17:
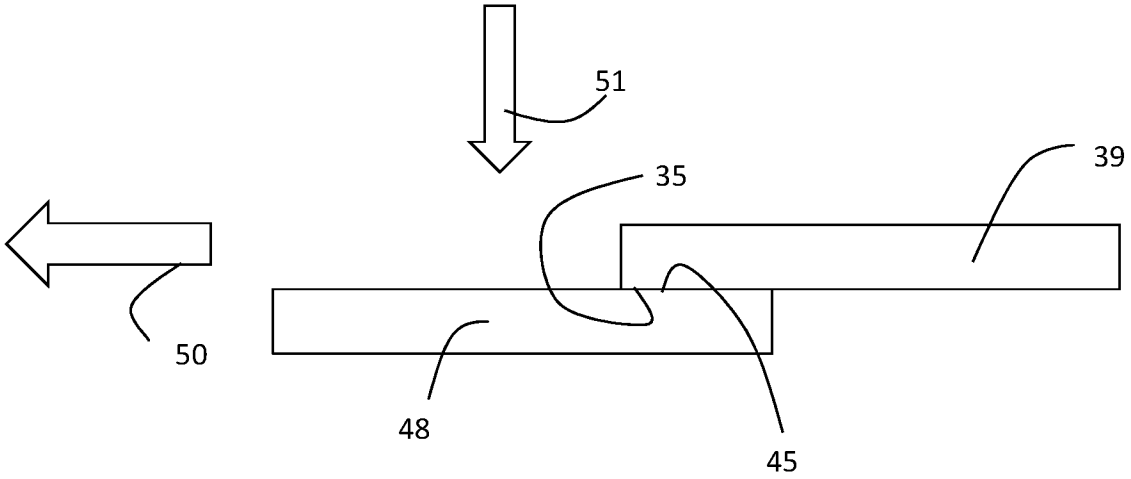
FIGS. 17 and 18 are top views of two further steps of the method of the invention applied to the spliced sheet of FIG. 16.

The waste portion 49 of the first sheet 4 and the waste portion 38 of the second sheet 3 may be removed after cutting the sheets 3,4. While the cutting does not necessarily have to be performed with aligned sheets, the splicing process does. As can be seen in FIG. 16, the sheets 4, 3 that have been cut are then aligned above each other with their cutting lines 47, 37 to overlie each other. The cut line 47 in reality is not visible, however it is depicted in FIG. 16 as a dotted line to show the overlapping portion 36. In the overlapping portions, two surfaces 45, 35, belonging to the first sheet and second sheet, respectively, referred to as the "cutting surfaces", are in contact to each other (shown in FIG. 17). While the cutting direction in FIG. 2 is inversed with respect to the cutting direction of the cutting knife 20 of FIG. 8, the splicing process is the same. The cutting angle α is in both figures about 30 degrees.

Water is dispensed onto the lower lying sheet 3 and onto the cutting face 35 by the dispensing unit 23. By a thin water layer (not visible in the drawings) applied to one sheet only, such as the second sheet 3, the water may soften the material of the sheets 3,4 at least in the area of the cutting surfaces 35, 45 to support a good interconnection of the sheets 3,4 in the overlapping area 36. However, the amount of water is small enough to not disintegrate the sheets.

Figure 18:
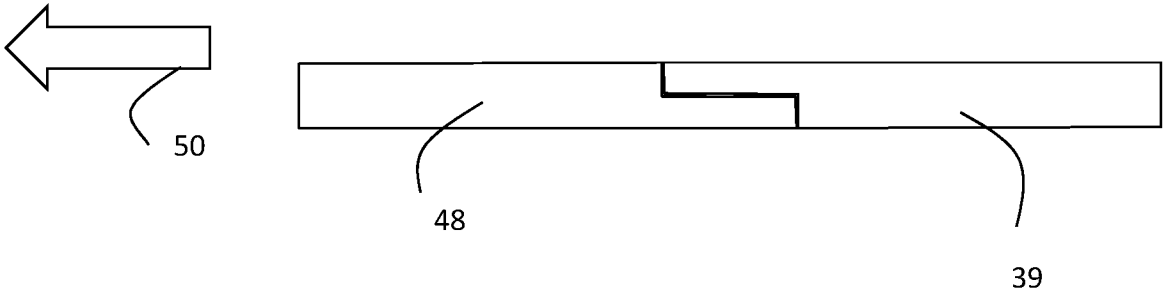

The so overlying and wetted sheets 3,4 are then guided through compressing rollers 24. The sheets are compressed upon passing between the compressing rollers, which securely fixes the two cutting surfaces 45,35 and the two sheets 3,4 to each other. The pressure applied by the compressing rollers 24 is indicated by an arrow 51 in FIG. 17. A short but firm connection is formed, as schematically shown in FIG. 18 or in FIG. 2. To support the joint formation, the heating unit 25 heats the combined sheets. By the heat, the connection is quickly dried such that the now spliced tobacco sheet may continue to be provided to further downstream arranged processing units.

Figure 4:
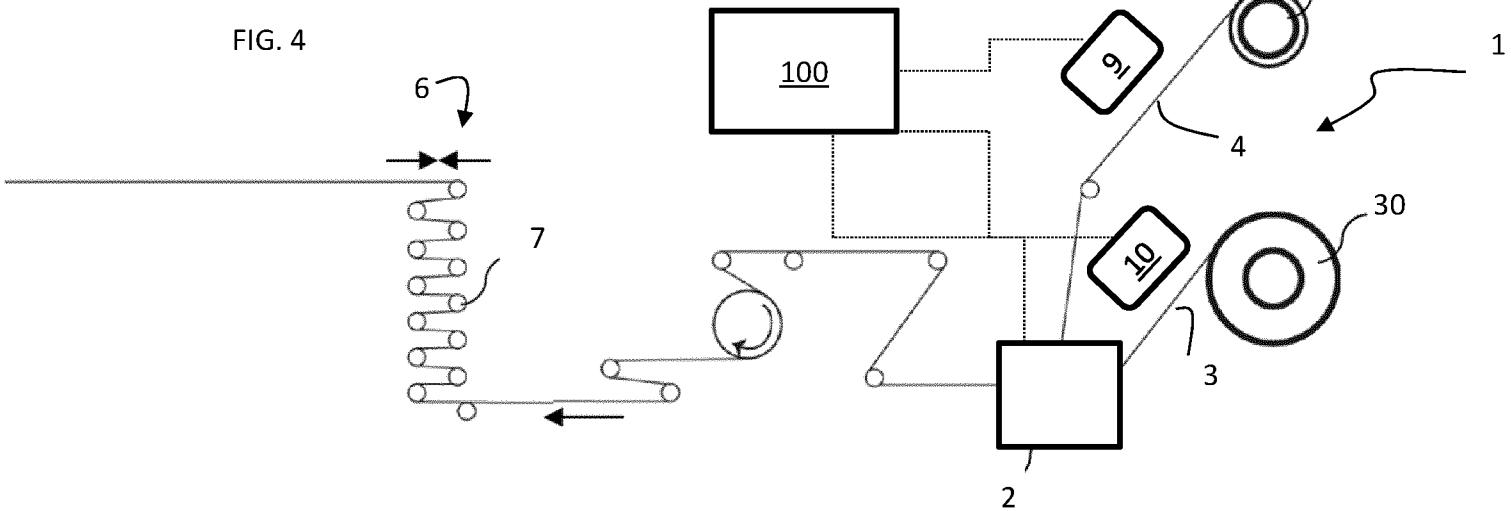

While the splicing takes place, due to the fact that the first sheet needs to be slowed down or stopped in order to perform the splicing, the first sheet 4 buffered in the buffer system 6 is used in the further processing steps. During the splicing therefore, the first sheet 4 in the buffer system 6 is used and the rollers 7 get closer to each other reaching a minimum distance, as depicted in FIG. 4.

When the splicing is commanded by the control unit 100, before it has taken place, the first bobbin 40 is rotated in anti-clockwise direction (indicated by arrow in FIG. 8) by the bobbin holder 11 away from the splicing unit 2. Upon the same rotating movement, the second bobbin 30 has been moved closer to the splicing unit 2. The second tobacco sheet 3 from the second bobbin 30 is guided via guide pulley 22 into the splicing unit 2, where splicing may be performed. After cutting in the splicing unit, the then cut off first tobacco sheet 4 may be removed together with the first bobbin 40 from the first shaft 41 in the bobbin holder 11. It may be replaced by a new bobbin. As soon as the second bobbin 30 comes to an end, the process may be started again.

By this process, a new bobbin is provided and prepared for the tobacco sheet on the new bobbin to being spliced with the tobacco sheet in use, while the tobacco sheet is continuously provided to the tobacco processing line.

The bobbin holder 11 is preferably rotated such that a new sheet may be provided from above. This simplifies the positioning of the new sheet on the upper surface of the sheet in use to be joined therewith.

An arrangement of mechanical dancer and pulley rolls 12,13 is provided on the bobbin holder 11 (see FIG. 8). They are arranged next to each of the respective first and second bobbins 30, 40. The tobacco sheets 3, 4 are guided over the rolls 12, 13 before being supplied into the splicing unit 2. By providing mechanical dancers and pulleys 12,13 a controlled guiding of the first or second tobacco sheet, as well as a constant tightening of the tobacco sheet may be achieved. This is especially favourable for tobacco sheet that tends to split or break upon large or irregular tearing or pulling forces. Especially, the rolls make up for varying pulling forces upon rotating the bobbins on the bobbin holder.

The same splicing described above may take place if the control unit receives a signal from a further diameter sensor (not detected) signalling that the first bobbin is going to be depleted soon.

For the purpose of the present description and of the appended claims, except where otherwise indicated, all numbers expressing amounts, quantities, percentages, and so forth, are to be understood as being modified in all instances by the term "about". Also, all ranges include the maximum and minimum points disclosed and include any intermediate ranges therein, which may or may not be specifically enumerated herein. In this context, therefore, a number A is understood as A±10 percent of A. Within this context, a number A may be considered to include numerical values that are within general standard error for the measurement of the property that the number A represents. The number A, in some instances as used in the appended claims, may deviate by the percentages enumerated above provided that the amount by which A deviates does not materially affect the basic and novel characteristic(s) of the claimed invention. Also, all ranges include the maximum and minimum points disclosed and include any intermediate ranges therein, which may or may not be specifically enumerated herein.

The invention claimed is:

1. A method for splicing two sheets of material containing alkaloids, the method comprising:

providing a first sheet of material containing alkaloids wound in a first bobbin;

providing a second sheet of material containing alkaloids wound in a second bobbin;

unwinding the first sheet of material containing alkaloids wound in the first bobbin;

evaluating one or more of the following parameters of the unwound first sheet of material containing alkaloids:

moisture of the first sheet of material containing alkaloids, thickness of the first sheet of material containing alkaloids, width of the first sheet of material containing alkaloids, stickiness of the first sheet of material containing alkaloids, and presence or absence of holes or tears in the first sheet of material containing alkaloids; and depending on a value of the evaluated one or more parameters, unwinding the second sheet of material containing alkaloids wound in the second bobbin, and splicing the first sheet of material containing alkaloids and the second sheet of material containing alkaloids.

2. The method according to claim 1, further comprising rejecting the first bobbin after the splicing.

3. The method according to claim 1, further comprising buffering a given length of the first sheet of material containing alkaloids before the splicing.

4. The method according to claim 1, further comprising:

capturing an image of the first sheet of material containing alkaloids; and determining, from the image, a width of the first sheet of material containing alkaloids or a presence or absence of holes or tears in the first sheet of material containing alkaloids.

5. The method according to claim 1, further comprising:

impinging a light beam onto the first sheet of material containing alkaloids; and determining a width or a thickness of the first sheet of material containing alkaloids or a presence or absence of holes or tears in the first sheet of material containing alkaloids from a characteristic of the light beam transmitted through the first sheet of material containing alkaloids.

6. The method according to claim 1, further comprising:

measuring a distance between the first sheet of material containing alkaloids and a first sensor; and determining, from the measured distance, a stickiness of the first sheet of material containing alkaloids.

7. The method according to claim 1, further comprising:

measuring a force needed to unwind the first sheet of material containing alkaloids from the first bobbin; and determining, from the measured force, a stickiness of the first sheet of material containing alkaloids.

8. The method according to claim 1, further comprising interchanging a position of the first bobbin and a position of the second bobbin after the splicing.

9. A system for splicing two sheets of material containing alkaloids, the system comprising:

a first shaft configured to hold, in a rotatable manner, a first bobbin of a first sheet of material containing alkaloids;

a second shaft configured to hold, in a rotatable manner, a second bobbin of a second sheet of material containing alkaloids;

one or more of the following first sheet sensors:

a moisture sensor configured to measure a moisture of the first sheet of material containing alkaloids and to emit a signal on the basis of the moisture measurement, a thickness sensor configured to measure a thickness of the first sheet of material containing alkaloids and to emit a signal on the basis of the thickness measurement, a width sensor configured to measure a width of the first sheet of material containing alkaloids and to emit a signal on the basis of the width measurement, a stickiness sensor configured to measure a stickiness of the first sheet of material containing alkaloids and to emit a signal on the basis of the stickiness measurement, and an optical sensor or a sound sensor configured to detect a presence or absence of holes or tears in the first sheet of material containing alkaloids;

a splicing unit configured to splice the first sheet of material containing alkaloids and the second sheet of material containing alkaloids, the splicing unit being located downstream of the one or more first sheet sensors; and a controller connected to the one or more sensors and to the splicing unit, and being configured to activate the splicing unit to splice the first sheet of material containing alkaloids and the second sheet of material containing alkaloids on the basis of the signal emitted by the one or more first sheet sensors.

10. The system according to claim 9, further comprising one or more of the following second sheet sensors:

a moisture sensor configured to measure a moisture of the second sheet of material containing alkaloids and to emit a signal on the basis of the moisture measurement, a thickness sensor configured to measure a thickness of the second sheet of material containing alkaloids and to emit a signal on the basis of the thickness measurement, a width sensor configured to measure a width of the second sheet of material containing alkaloids and to emit a signal on the basis of the width measurement, a stickiness sensor configured to measure a stickiness of the second sheet of material containing alkaloids and to emit a signal on the basis of the stickiness measurement, and an optical sensor or a sound sensor configured to detect a presence or absence of holes or tears in the second sheet of material containing alkaloids.

11. The system according to claim 9, wherein the stickiness sensor is a distance sensor or a force sensor.

12. The system according to claim 9, wherein the width sensor is an optical sensor including a light source.

13. The system according to claim 9, further comprising a bobbin holder comprising the first shaft and the second shaft, the bobbin holder being configured to interchange a position of the first shaft and the second shaft.

14. The system according to claim 9, further comprising a buffer configured to buffer a variable amount of the first sheet of material containing alkaloids or of the second sheet of material containing alkaloids, the buffer being located downstream of the splicing unit.

* * * * *